US007215904B2

(12) United States Patent
Hasegawa et al.

(10) Patent No.: US 7,215,904 B2
(45) Date of Patent: May 8, 2007

(54) IMAGE FORMING APPARATUS GROUP

(75) Inventors: Hideaki Hasegawa, Susono (JP); Takeo Shoji, Shizuoka-ken (JP); Satoshi Sunahara, Shizuoka-ken (JP); Atsushi Toda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 11/052,525

(22) Filed: Feb. 8, 2005

(65) Prior Publication Data

US 2005/0175366 A1 Aug. 11, 2005

(30) Foreign Application Priority Data

Feb. 10, 2004 (JP) ..... 2004-033508
Jan. 31, 2005 (JP) ..... 2005-023509

(51) Int. Cl.
*G03G 21/18* (2006.01)

(52) U.S. Cl. ..... 399/111; 399/110

(58) Field of Classification Search ..... 399/119, 399/27, 110, 111

See application file for complete search history.

(56) References Cited

U.S. PATENT DOCUMENTS

| | | | | |
|---|---|---|---|---|
| 5,095,335 | A | 3/1992 | Watanabe et al. | |
| 5,331,372 | A | 7/1994 | Tsuda et al. | |
| 5,455,665 | A | 10/1995 | Baba et al. | |
| 5,470,635 | A | 11/1995 | Shirai et al. | 428/131 |
| 5,565,961 | A | 10/1996 | Shoji et al. | |
| 5,608,509 | A | 3/1997 | Shirai et al. | 399/351 |
| 5,828,928 | A | 10/1998 | Sasago et al. | 399/111 |
| 5,835,818 | A | 11/1998 | Hoshika et al. | 399/26 |
| 5,884,124 | A | 3/1999 | Karakama et al. | 399/123 |
| 5,987,269 | A | 11/1999 | Allen et al. | 399/27 |
| 6,128,462 | A | 10/2000 | Kato et al. | 399/350 |
| 6,134,396 | A | 10/2000 | Kaneko | 399/55 |
| 6,175,703 | B1 | 1/2001 | Nakazono et al. | 399/111 |
| 6,253,044 | B1 | 6/2001 | Shoji et al. | 399/111 |
| 6,415,112 | B1 | 7/2002 | Kimizuka et al. | 399/27 |
| 6,591,070 | B1 | 7/2003 | Shoji et al. | 399/27 |
| 6,597,876 | B1 | 7/2003 | Sakurai et al. | 399/25 |
| 6,661,980 | B2 | 12/2003 | Matsumoto et al. | 399/27 |
| 6,836,639 | B2 | 12/2004 | Karakama et al. | 399/351 |

(Continued)

FOREIGN PATENT DOCUMENTS

JP 56-62275 A 5/1981

(Continued)

*Primary Examiner*—Susan Lee
(74) *Attorney, Agent, or Firm*—Fitzpatricks, Cella, Harper & Scinto

(57) ABSTRACT

In an image forming apparatus group including a plurality of kinds of image forming apparatuses having different process speeds, and a cartridge which can be commonly used in a plurality of kinds of image forming apparatuses, when there is provided a cartridge which can be detachably mountable to both a first image forming apparatus and a second image forming apparatus having different process speeds, n a control operation is carried out such that the difference between the peak-to-peak A.C. voltages in first and second first image forming apparatus main bodies varies with an increase in amount of used toners in the cartridge. Even when use of the cartridge is changed between the image forming apparatuses in the middle of being used, the image density level of an output image can be maintained nearly constant.

23 Claims, 15 Drawing Sheets

U.S. PATENT DOCUMENTS

| | | | | |
|---|---|---|---|---|
| 6,882,806 | B2 | 4/2005 | Sunahara et al. | 399/50 |
| 6,892,035 | B2 | 5/2005 | Matsumoto et al. | 399/27 |
| 2003/0165344 | A1 | 9/2003 | Ohtomo et al. | 399/27 |
| 2003/0215253 | A1 | 11/2003 | Okano et al. | 399/50 |
| 2004/0131393 | A1 | 7/2004 | Otomo et al. | 399/274 |
| 2004/0136740 | A1 | 7/2004 | Shoji | 399/50 |

FOREIGN PATENT DOCUMENTS

| | | | | |
|---|---|---|---|---|
| JP | 57-19769 | A | | 2/1982 |
| JP | 59-184375 | A | | 10/1984 |
| JP | 11-272048 | A | | 10/1999 |
| JP | 2002-244365 | A | | 8/2002 |
| JP | 2002244382 | A | * | 8/2002 |

* cited by examiner

IMAGE FORMING APPARATUS GROUP

BACKGROUND OF THE INVENTION

1. Field of the Invention

The present invention generally relates to an image forming apparatus group having a plurality of image forming apparatuses each employing an electrophotographic process and having different process speeds.

Here, an image forming apparatus includes an electrophotographic copying machine, an electrophotographic printer, such as an LED printer or a laser beam printer, and electrophotographic facsimile terminal equipment, each employing an electrophotographic process, and an image forming apparatus or the like using an electrostatic recording process.

2. Related Background Art

In an image forming apparatus using an electrophotographic process, such as a copying machine or a laser beam printer, light corresponding to image information is applied to a surface of a photosensitive member serving as a charged image bearing member to form a latent image on the surface of the photosensitive member by exposing means. A developer (toners) as a recording material is supplied to the latent image by a developing apparatus to visualize the latent image to obtain a developed image (toner image), and the developed image is transferred from the surface of a photosensitive member to a recording sheet as a recording medium, thereby forming an image on the recording sheet.

With respect to a developing apparatus using dry one-component development, various kinds of developing apparatuses have been proposed. Then, the following method is used as the most general method. That is, this method is employed such that a uniform toner layer is formed on a developing roller as a developer carrying member by a regulating member, and a developing bias voltage having an A.C. component and a D.C. component is applied to the developing roller to carry out the developing based on a difference in electric potential between an electrostatic latent image on a surface of a photosensitive member and the developing roller.

In the above-mentioned developing apparatus, a toner container as a toner containing portion is linked to a developing portion including the developing roller and the regulating member, and the toners are consumed as images are formed. The developing apparatus having the toner container, the photosensitive member, a charging means for charging the surface of the photosensitive member with electricity in order to form the latent image on the surface of the photosensitive member, and the like are constructed integrally with one another in the form of a process cartridge in many cases. Thus, when the toners are completely consumed, a user exchanges the old process cartridge for a new one, thereby allowing an image to be formed again. To know at any time how much toner, which is able to be supplied for image formation, remains within the process cartridge, a developer amount detecting system capable of successively detecting a toner remaining amount level is provided in the process cartridge or an image forming apparatus main body in some cases. Of such cases, in a case of a method of detecting a toner remaining amount by measuring an electrostatic capacity between electrode members, an added circuit is relatively simple in configuration, and high precision measurement is obtained. Thus, several methods are proposed. U.S. Pat. No. 5,987,269 discloses a method of successively detecting a toner amount by measuring an electrostatic capacity between sheet metal-like electrodes.

Also, U.S. Pat. No. 6,415,112 proposes a method of successively detecting a toner amount by measuring an electrostatic capacity between a sheet metal-like electrode member provided within an image forming apparatus or within a process cartridge, and a developing roller.

In recent years, high speed promotion of a process speed and long life promotion of a process cartridge have been required for an image forming apparatus in which the process cartridge is adapted to be mounted to an image forming apparatus main body as described above. Thus, a toner amount (toner capacity) filled in a toner container has tended to increase. Here, the process speed generally means a rotational speed of a photosensitive drum. Thus, the number of recording sheets on which images are formed per hour further increases as the process speed becomes higher. Under such circumstances, when excellent images are intended to be maintained for a long term from the beginning of use of the process cartridge to a time point when the toner is completely consumed, various problems arise A long term change of the developing characteristics due to a change in a state of the toners is important. In particular, in order to stably maintain an image density level, heretofore, various proposals have been made.

Japanese Patent Application Laid-Open No. S59-184375 proposes a method in which, in order to supplement a reduction in the image density level when toner is supplied, an effective value of a developing bias voltage is controlled in correspondence to a toner remaining amount within a toner container. In addition, Japanese Patent Application Laid-Open No. S56-62275 proposes a method in which a peak-to-peak voltage of a developing bias voltage is changed in correspondence to the number of sheets of copies to supplement an image density level and to simultaneously reduce fog. In addition, Japanese Patent Application Laid-Open No. 2002-244365 discloses a control method in which a peak-to-peak voltage and a frequency of a developing bias voltage are changed in correspondence to an amount of remaining toner and the environment, thereby supplementing an environmental fluctuation and a long term change of developing characteristics. Also, Japanese Patent Application Laid-Open No. S57-19769 proposes a method in which a developing bias voltage is controlled in correspondence to the dead time of a developing apparatus and the number of sheets of copies, thereby supplementing the rise of developing characteristics after stoppage for a long time. Moreover, Japanese Patent Application Laid-Open No. H11-272048 proposes a method in which a developing bias voltage is controlled in correspondence to the dead time of a developing apparatus and the environment, thereby supplementing the rise of developing characteristics after stoppage for a long time.

In addition, U.S. Pat. No. 6,134,396 proposes a method including changing a peak-to-peak voltage of a developing bias voltage based on use history information of a developer. Also, U.S. Pat. No. 6,597,876 discloses a method including changing process conditions based on information inherent in a process cartridge which is stored in a storage medium mounted to a process cartridge.

However, recently, an image forming apparatus group has been required which can cope with various applications of users by allowing a process cartridge common to a plurality of image forming apparatus main bodies different in their process speeds to be used.

When the common process cartridge can be used in the image forming apparatuses different in their process speeds, it is important that even when the process cartridge used in a certain image forming apparatus is used in another image forming apparatus in the middle of being used, an excellent image is obtained without any fluctuation in image level.

However, when the same process cartridge is used in an image forming apparatus main body (f) having a process speed of Vf mm/sec and an image forming apparatus main body (s) having a process speed of Vs mm/sec lower than Vf, there is encountered a problem that as shown in FIG. 3, a difference in image density becomes large along with an increase in the amount of used toner (a decrease in the amount of remaining toner).

It is considered that this problem is caused by the influence of a long term change in particle size distribution of toners, i.e., a so-called selection phenomenon due to the fact that the toners, each of which has a relatively small particle diameter and which has an excellent developing property, are preferentially consumed. At the beginning of use, both the toners each having a small particle diameter and the toners each having a large particle diameter are contained in the developing apparatus within the process cartridge. Since the toners each having a small particle diameter are sensitive to the developing bias voltage and have an excellent developing property, the development can be carried out at nearly the same density for a latent image irrespective of a high process speed and a low process speed when a latent image is developed with those toners. However, when the toners are continuously used for a long period of time, only the toners each having a large particle diameter remain since the toners each having a small particle diameter are preferentially consumed. The toners each having a large particle diameter have an inferior developing property to the toners each having a small particle diameter, and hence have a high process speed. Thus, in the image forming apparatus in which a short period of time is required for a photosensitive drum to pass through a developing area, that is, an area facing the photosensitive drum and the developing roller, the development is not sufficiently carried out, and hence sufficient density is hard to obtain. Consequently, when the process cartridge in the middle of being used in an image forming apparatus is used in another image forming apparatus different in process speed from the image forming apparatus, the difference in image density between those two image forming apparatuses becomes large.

It is an object of the present invention to reduce density differences among images output from a plurality of image forming apparatuses even when a cartridge which is commonly and detachably mountable to a plurality of image forming apparatus main bodies is changed and used among a plurality of image forming apparatus main bodies in an image forming apparatus group including a plurality of image forming apparatuses that are different in process speed from one another.

SUMMARY OF THE INVENTION

The present invention has been made in order to solve the above-mentioned problems.

According to the present invention, in the image forming apparatuses which are different in their process speeds, even when a cartridge which is commonly and detachably mountable to a plurality of image forming apparatus main bodies is changed and used among a plurality of image forming apparatus main bodies, the density differences among images output from the respective image forming apparatuses can be reduced.

DESCRIPTION OF THE PREFERRED EMBODIMENTS

An image forming apparatus and a process cartridge according to the present invention will hereinafter be described in more detail with reference to the accompanying drawings.

First Embodiment

Figure 2:
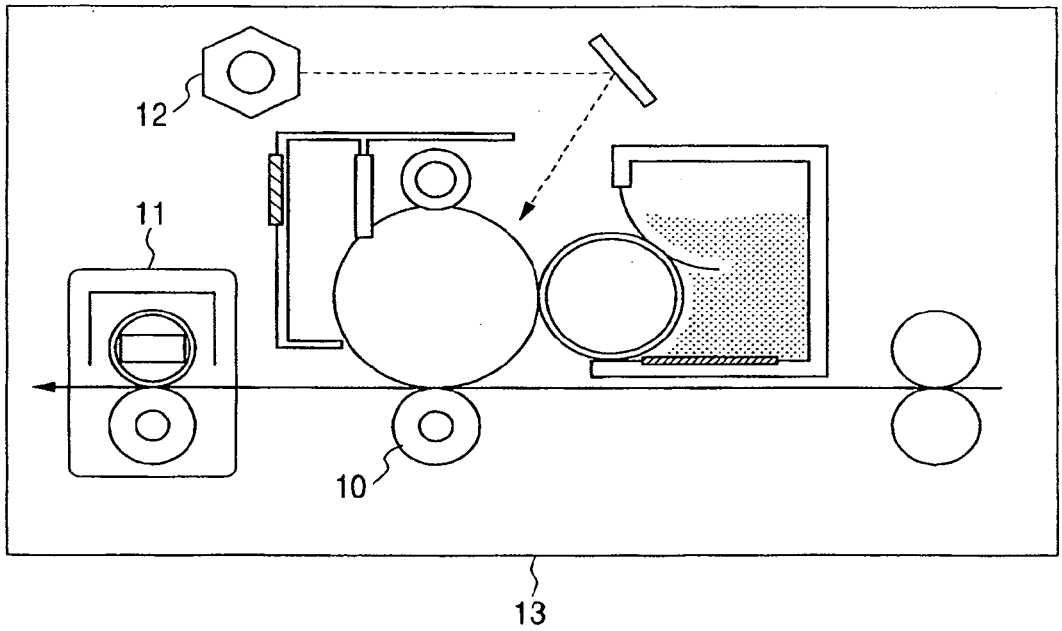
FIG. 2 is a schematic cross sectional view showing a construction of an image forming apparatus according to the present invention.
Figure 3:
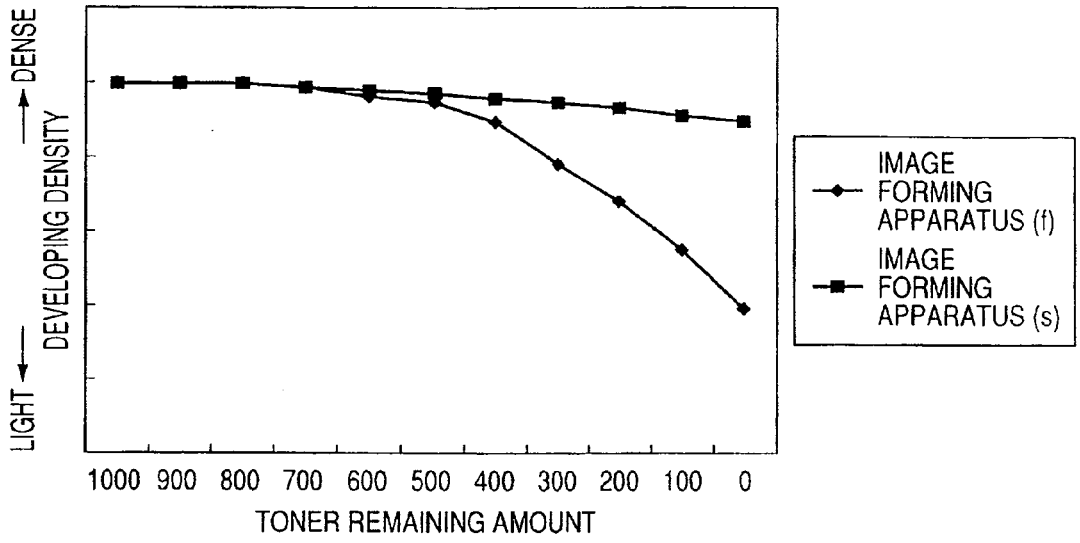
FIG. 3 is a graphical representation showing the dependency of an image density on a process speed.

In the First Embodiment, a description will now be provided using an image forming apparatus, using an electrophotographic process, as an image forming apparatus. Note that while the present invention can be applied to an image forming apparatus as well as using an electrostatic recording process, the present invention is especially effective for the image forming apparatus using the electrophotographic process. The image forming apparatus of the First Embodiment, as shown in FIG. 2, is a laser beam printer for receiving image information from a host computer, a network or the like to output the image information in the form of an image onto a recording sheet. The image forming apparatus includes a process cartridge C as a cartridge, and an image forming apparatus main body 13 as an image forming apparatus main body. The process cartridge C is constructed so that the process cartridge C can be inserted and mounted to the image forming apparatus main body 13 and can be detached from the image forming apparatus main body 13 in a predetermined manner.

Figure 1:
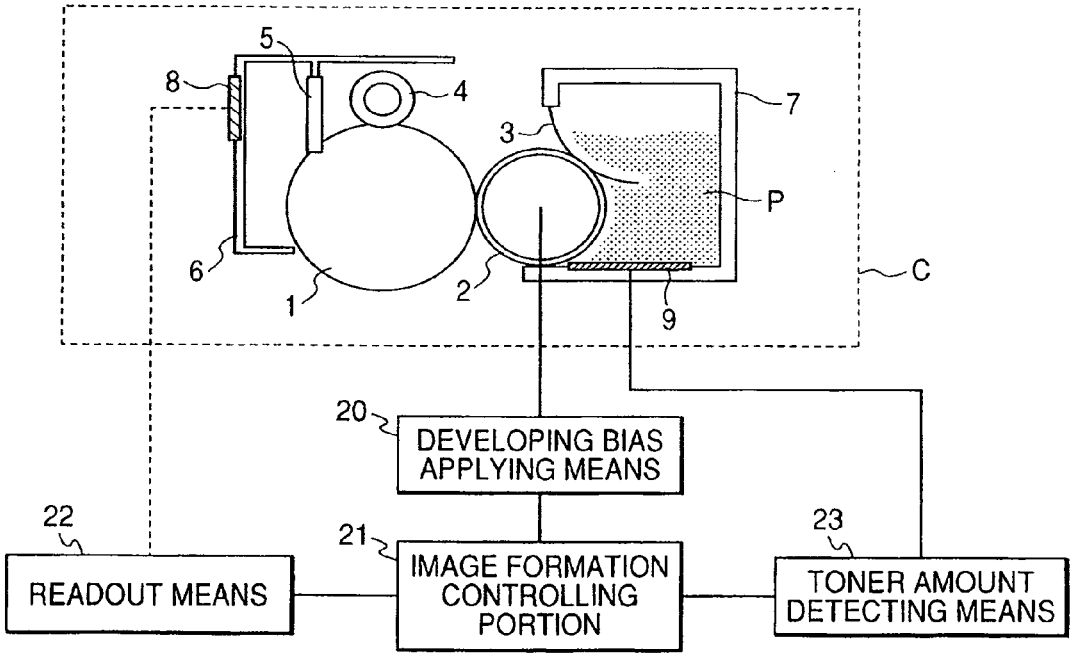
FIG. 1 is a diagram showing a process cartridge and a control circuit according to the present invention.

FIG. 1 shows the process cartridge C mounted to the image forming apparatus main body 13. As shown in FIG. 1, in the process cartridge C, a developing apparatus includes a photosensitive member 1 as an image bearing member, a charging roller 4 as charging means for uniformly charging the surface of the photosensitive member 1 with electricity, a developing roller 2, as a developer carrying member, which is disposed so as to face the photosensitive member 1 in a non-contact manner, a toner regulating member 3 for regulating toners as a developer, and a toner container 7 as a developer container for containing therein toners P; cleaning means 5; and a waste toner container 6 for containing therein waste toners removed from the photosensitive member 1 by the cleaning means 5 are constructed integrally with one another in the form of a unit. Note that the developing apparatus, including at least the developing roller 2 and the toner container 7, and the like, are united integrally with each other in the form of a cartridge, and the cartridge is allowed to be detachably mounted to the image forming apparatus main body. In the First Embodiment, one-component magnetic toners are used as the toners to carry out reversal development, and the developing roller 2 includes therein a magnet, and its surface is covered with a sleeve. Then, the photosensitive member 1 and the developing roller 2 are opposed to each other in a non-contact manner, and an alternating electric field is formed between the photosensitive member 1 and the developing roller 2 by a D.C. voltage and an A.C. voltage, which are applied in the form of a developing bias voltage to the developing roller 2 to make the toners fly towards the surface of the photosensitive member 1, thereby carrying out the development. That is, a toner layer borne by the developing roller 2 is formed so as not to contact the surface of the photosensitive member 1. Then, the developing bias voltage to be applied to the developing roller 2 is set so that an alternating electric field is formed between both a dark portion and a light portion of an electrostatic latent image on the surface of the photosensitive member 1, and the developing roller 2.

In the image forming apparatus main body 13 to which the process cartridge C is mounted, as shown in FIG. 2, a laser scanner 12 as exposing means for radiating a laser beam in correspondence to image information is disposed above the process cartridge C, and transfer means 10 is disposed below the process cartridge C so as to oppose to the surface of the photosensitive member 1.

With the above-mentioned construction, the surface of the photosensitive member 1 is uniformly charged with electricity by the charging roller 4, and is scanned and exposed with the laser beam applied from the laser scanner 12 to form thereon a target electrostatic latent image corresponding to image information. The electrostatic latent image formed on the surface of the photosensitive member 1 is visualized in the form of a toner image by sticking toners P onto the surface of the photosensitive member 1 based on an operation of the developing bias voltage as a voltage which is obtained by superposing the D.C. voltage and the A.C. voltage applied to the developing roller 2 of the developing apparatus. The toner image formed on the surface of the photosensitive member 1 is transferred onto a recording sheet as a recording medium by transfer means 10. The toner image is fixed as an image to the recording sheet while the recording sheet passes through the fixing means 11, and the recording sheet having the image formed thereon is then discharged to the outside of the image forming apparatus main body.

As shown in FIG. 1, an electrode member 9 is disposed as a toner remaining amount detecting member within the toner container 7 of the process cartridge C. When the developing bias voltage as the voltage which is obtained by superposing the D.C. voltage and the A.C. voltage is applied to the developing roller 2 during image formation, a current corresponding to a dielectric constant defined between the developing roller 2 and the electrode member 9 is induced in the developing roller 2. Since the dielectric constant of the air and the toners are different, it is possible to determine the present amount of the toners between the developing roller 2 and the electrode member 9 and hence it is possible to detect a toner remaining amount. Note that while in the First Embodiment, there is used a toner remaining amount detecting system utilizing an electrostatic capacity change corresponding to a toner amount change, any other method may also be utilized as long as a toner amount can be measured in accordance with this method.

Next, an image forming apparatus group in the First Embodiment will be described.

The image forming apparatus group in the First Embodiment has two kinds of image forming apparatuses which have different process speeds. It is possible in this image forming apparatus group that the process cartridge is detached from one image forming apparatus in the middle of being used to be mounted to the other image forming apparatus. Here, the process speed is a peripheral speed of the photosensitive drum 1 as the image bearing member. Thus, the number of the recording sheets each having an image formed thereon per unit of time further increases as the process speed further increases. Note that increasing the speed of the photosensitive member generally changes the peripheral speeds of the charging roller 4 and the developing roller 2 as other process means. In the First Embodiment, the peripheral speed of the developing roller 2 is set so as to become 1.2 times as high as that of the photosensitive member 1. That is, the ratio of the peripheral speed of the developing roller 2 to the peripheral speed of the photosensitive member 1 is set to a constant value, i.e., 1.2 irrespective of the process speed.

In order to make the process speeds different between two kinds of image forming apparatuses, for example, a rotating speed of a motor for driving the photosensitive member 1 and the developing roller 2 has to be set so as to be different between the two kinds of image forming apparatus main bodies.

The image forming apparatus group in the First Embodiment will hereinafter be concretely described.

The two kinds of image forming apparatuses which are different in their process speeds are an image forming apparatus (f) as a first image forming apparatus having a process speed of Vf=300 mm/sec, and an image forming apparatus (s) as a second image forming apparatus having a process speed of Vs=200 mm/sec. As previously stated in a section of Related Background Art for the image forming apparatus group, the image forming apparatus group is more easily susceptible to the influence of a large change in the toners as the process speed is higher, and hence the reduction in image density accompanying this influence is large. When the process speed exceeds 300 mm/sec, the influence exerted on the reduction in image density becomes large. Consequently, the control, as will be described in Embodiment 1, is carried out between the image forming apparatus having a process speed equal to or higher than 300 mm/sec and the image forming apparatus having a process speed equal to or lower than 300 mm/sec, whereby such an effect of the present invention as to reduce a difference in image density between the image forming apparatuses becomes more remarkable.

For the process cartridge C, as previously stated, the developing apparatus including the photosensitive member 1, the charging roller 4, the developing roller 2, and the toner container 7, and the like are integrally constructed in the form of the unit, and the process cartridge C is used commonly to the two kinds of image forming apparatuses which are different in their process speeds. The toners of 1,000 g are accommodated in the toner container 7.

The First Embodiment provides the image forming apparatus group with which no faulty image is formed even when the use of the process cartridge is changed between the image forming apparatuses different in their process speeds, and hence no large difference is generated in image density level in the above-mentioned image forming apparatus group. Thus, an A.C. component of the developing bias voltage to be applied to the developing roller 2 is changed in correspondence to an amount of consumption of developer.

In the First Embodiment, information on an amount of consumption of developer is measured by toner amount detecting means 23 as developer detecting means for successively detecting a toner amount accommodated in the toner container 7. That is, the amount of consumption of developer is judged from the amount of remaining developer at the point in time of the detection. The toner amount detecting means 23 is provided in the image forming apparatus main body, and serves to detect a toner remaining amount by detecting a current which is induced in the electrode member 9 in correspondence to a toner amount between the developing roller 2 and the electrode member 9. An image formation controlling portion 21 as control means for controlling the developing bias voltage changes the developing bias voltage as the developing condition in accordance with such information, and information on the process speed during the image formation. Thus, the optimal developing bias voltage is applied from developing bias applying means 20 to the developing roller 2. Note that the developing bias applying means 20 is provided in the image forming apparatus main body. As shown in FIG. 1, a storage medium in which electronic information on a toner remaining amount is stored is mounted to each of the process cartridges. The storage medium stores therein information on a toner remaining amount measured by the toner amount detecting means 23 of the corresponding process cartridge. The image forming apparatus main body includes readout means 22 accessible to this storage medium. The information on an amount of consumption of developer is stored in the storage medium (memory) in such a manner, whereby even when the cartridge is detached from the image forming apparatus main body in the middle of being used, or the use of the cartridge is changed between the image forming apparatus main bodies, the information is held in the cartridge. Consequently, even when the use of the cartridge is changed between the image forming apparatus main bodies, no fluctuation of the image density level is generated, and hence an excellent image can be obtained. Note that the image formation controlling portion 21, the readout means 22, and the toner amount detecting means 23 in the First Embodiment designate a CPU provided in the image forming apparatus main body.

In the First Embodiment, in any of the image forming apparatuses, the developing bias voltage which is obtained by superposing the D.C. component of −450 V and the peak-to-peak voltage, 1,600 V, of the A.C. voltage is applied as its standard voltage to the developing roller 2. At this time, a gap provided between the photosensitive member 1 and the developing roller 2 is 300 μm which is set so that an electric potential in a dark portion on the surface of the photosensitive member 1 (an electric potential in a non-image portion) is made −600 V by the charging means. An electric potential in a light portion, obtained through the exposure process in an exposing apparatus, on the surface of the photosensitive member 1 (an electric potential in an image portion) is −150 V.

The contents of the control for the developing bias voltage will now be described. In the image forming apparatus (f) having the high process speed, when a toner remaining amount W becomes equal to or smaller than 300 g, the peak-to-peak voltage of the A.C. voltage of the developing bias voltage is changed from 1,600 V to 1,800 V. On the other hand, in the image forming apparatus (s) having the low process speed, the peak-to-peak voltage is held constant, i.e., at 1,600 V irrespective of a toner remaining amount W.

Table 1 shows the contents of the control for the developing bias voltage in the First Embodiment.

TABLE 1

| | Peak-to-peak voltage of A.C. voltage of developing bias voltage |
|---|---|
| Image forming apparatus High speed apparatus | 1,600 V when toner remaining amount W > 300 g and 1,800 V when W ≦ 300 g |
| Image forming apparatus Low speed apparatus | 1,600 V irrespective of toner remaining amount W |

Figure 5:
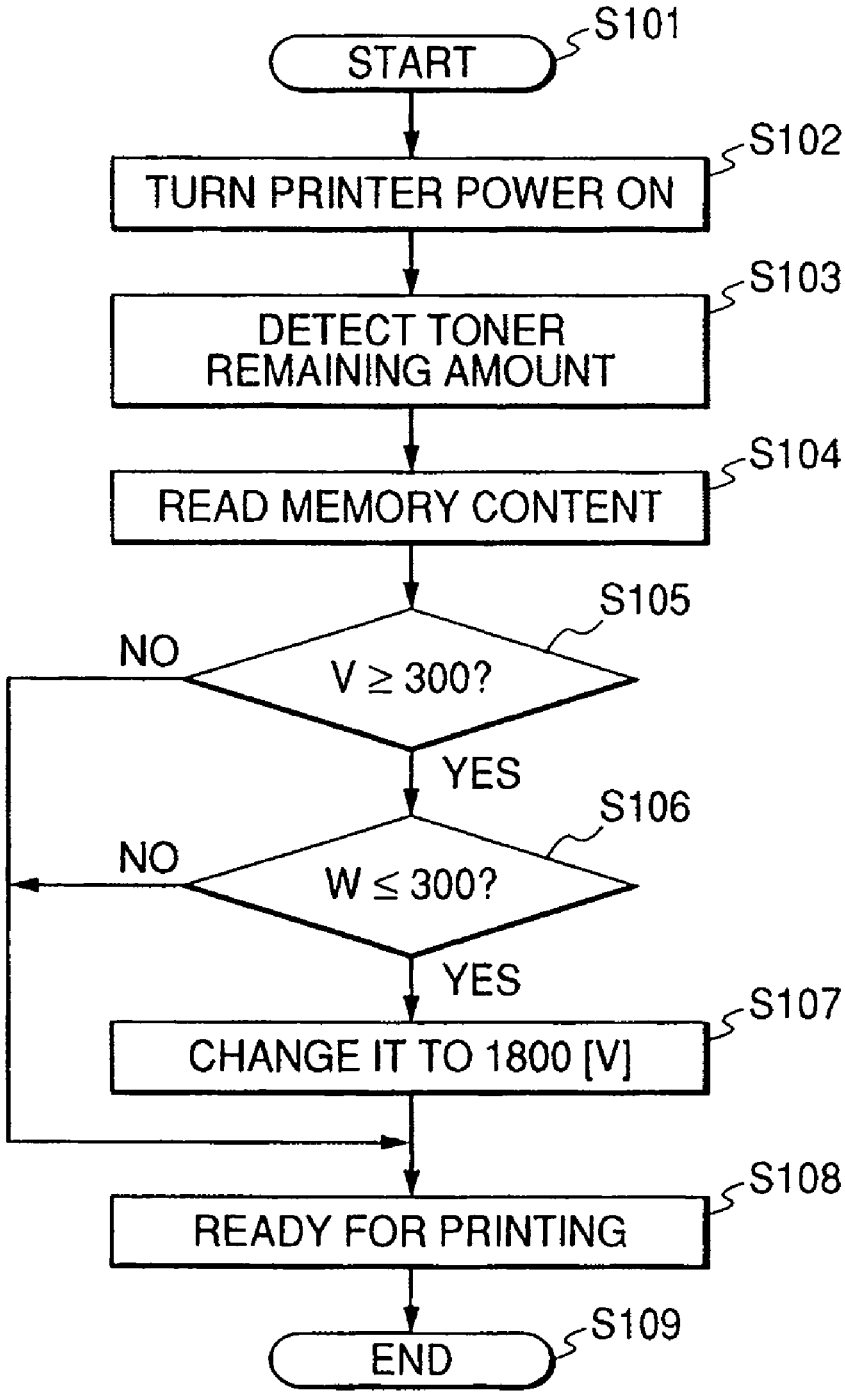
FIG. 5 is a flow chart showing a control flow according to the First Embodiment of the present invention.

Next, a processing method will be described in brief with reference to a flow chart shown in FIG. 5.

An operation is started to be carried out (S101). When a power source of the printer is turned ON (S102), the toner remaining amount detecting means detects a toner remaining amount W in the process cartridge (S103) and at the same time writes information on a toner remaining amount W to the storage medium. In addition, the readout means 22 provided on a side of the image forming apparatus main body accesses the storage medium mounted to the process cartridge to detect a toner remaining amount W in the process cartridge (S104). Such information is transmitted to the image formation controlling portion 21. First of all, when the process speed V used for the image formation is judged to be lower than 300 mm/sec based on the previously stored process speed information, the image formation controlling portion 21 enters a print standby state without changing the developing bias voltage (S108). On the other hand, when the process speed V is judged to be equal to or higher than 300 mm/sec, the image formation controlling portion 21 executes a processing corresponding to toner remaining amount detection results (S105). Next, a processing is executed based on the toner remaining amount information. When W>300 g, the developing bias voltage is not changed, while when W≦300 g, the image formation controlling portion 21 changes the peak-to-peak voltage of the A.C. voltage of the developing bias voltage to 1,800 V (S106 and S107) to enter the print standby state (S108), thereby completing the operation (S109).

The above-mentioned process flow is carried out when the process cartridge is mounted in or detached from the image forming apparatus main body as well as when the power source of the printer is turned ON. Hence, in a case as well where the process cartridge is changed and used in a different image forming apparatus in the middle of being used therein, the optimal developing bias voltage can be applied to the developing roller 2.

In the above-mentioned control, the number of times of change of the developing bias voltage, a timing (a toner remaining amount), and a value of the amplitude of the A.C. voltage component may be individually set based on a combination of the capacity of the process cartridge and the process speed of the image forming apparatus. Thus, the above-mentioned values are merely given as an example in the image forming apparatus group used in the First Embodiment, and hence the present invention is not especially limited thereto. For example, a three-stage setting may be adopted in which the peak-to-peak voltage of the A.C. voltage of the developing bias voltage is set to 1,600 V when W<300 g, 1,800 V when 200 g<W≦300 g, and 2,000 V when W≦200 g. Alternatively, a three or more-stage setting may also be adopted.

Figure 4:
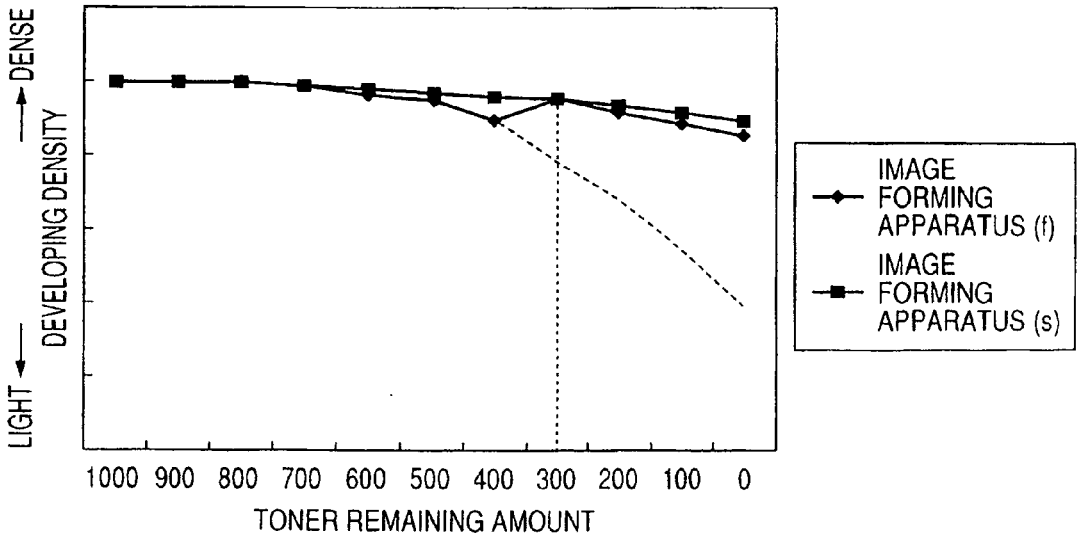
FIG. 4 is a graphical representation showing a change in image density when a control flow is carried out according to the First Embodiment of the present invention.

In such a manner, when the toner remaining amount becomes smaller, i.e., when the amount of used toners becomes large, the difference in peak-to-peak voltage of the A.C. voltage of the developing bias voltage between the image forming apparatuses (f) and (s) is changed, whereby a difference in image density caused by a difference in process speed can be reduced between the image forming apparatuses (f) and (s) different in their process speeds as shown in FIG. 4. At this time, the peak-to-peak voltage of the A.C. voltage of the developing bias voltage for the image forming apparatus (f) is controlled so as to be made larger than that for the image forming apparatus (s). This control utilizes a phenomenon in which the developing property is improved to increase the image density by increasing the peak-to-peak voltage of the A.C. voltage of the developing bias voltage. As previously described, in the image forming apparatus (f) having the high process speed, the developing property is further reduced to decrease the image density as the amount of used toners becomes larger. However, the reduction in image density can be prevented by the control for the peak-to-peak voltage of the A.C. voltage of the developing bias voltage. Note that in the First Embodiment, the image density is measured with a well known optical density sensor (MacbethRD918).

Note that in the First Embodiment, the peak-to-peak voltages of the A.C. voltages of the developing bias voltages are held at the same value, i.e., 1,600 V in both the image forming apparatuses (f) and (s) until an amount of used toners in the process cartridge becomes a predetermined value, to be specific, until the toner remaining amount W reaches 300 g. Thus, this is preferable since even when the process cartridge is mounted to either the image forming apparatus (f) or (s) in a state where the image density hardly undergoes the influence of the process speed at the beginning of use of the process cartridge, the densities of the output images can be made equal to each other. But, in a range allowing a difference in image density, the peak-to-peak voltages of the A.C. voltages of the developing bias voltages at the beginning of use of the process cartridge in the image forming apparatuses (f) and (s) may be set to different values, respectively.

In addition, in the First Embodiment, in the case of the image forming apparatus (s), the peak-to-peak voltage of the A.C. voltage of the developing bias voltage is held at 1,600 V, i.e., the peak-to-peak voltage of the A.C. voltage of the developing bias voltage is not changed in correspondence to the amount of used toners. As a result, the cost required for the production can be reduced since the design and circuit for controlling the peak-to-peak voltage of the A.C. voltage of the developing bias voltage do not need to be provided in the image forming apparatus (s).

Note that in the First Embodiment, the D.C. voltage of the developing bias voltage is held at a constant value, i.e., at −450 V. Since the D.C. voltage exerts an influence on the line width of a line image, the D.C. voltage is preferably held at a constant value if circumstances allow. In addition, the D.C. voltages of the developing bias voltages for the image forming apparatuses (f) and (s) are set to the same value, i.e., −450 V. As a result, the line widths of the line images can be similarly controlled in both the image forming apparatuses (f) and (s).

In the First Embodiment, when the conditions for the developing bias voltages are intended to be determined, the use history for each image forming apparatus (how much the process cartridge has been used until now in the image forming apparatus (f), and how much the process cartridge has been used until now in the image forming apparatus (s)) is not taken into consideration. This is because the influence of the reduction in developing density due to the process speed of the image forming apparatus when a toner amount each having a small particle diameter has decreased due to the selection phenomenon is more significant than that of the reduction in developing density due to the use history of the process cartridge for each image forming apparatus.

Second Embodiment

In the Second Embodiment, in order to reduce the difference in image density due to a difference in process speed in the First Embodiment, the value of the D.C. voltage of the developing bias voltage is changed in correspondence to the amount of consumption of developer. Note that descriptions of the same points in process speed, construction, etc., of each image forming apparatus as those in the First Embodiment are omitted here for the sake of simplicity.

With respect to the developing bias voltages for the image forming apparatuses (f) and (s) in the Second Embodiment, in each of the image forming apparatuses (f) and (s), a voltage obtained by superposing a D.C. component of −450 V, and a peak-to-peak voltage, 1,600 V, of an A.C. voltage is applied as a standard voltage for the developing bias voltage to the developing roller 2.

The contents of the control for the developing bias voltage will hereinafter be described. In the case of the image forming apparatus (f) having the high process speed, when a toner remaining amount W becomes equal to or smaller than 300 g, the D.C. voltage of the developing bias voltage is changed from −450 V to −500 V. On the other hand, in the case of the image forming apparatus (s) having the lower process speed, the D.C. voltage of the developing bias voltage is held at a constant value, i.e., at −450 V irrespective of a toner remaining amount W.

Table 2 shows the control contents in the Second Embodiment. Since the control flow in the Second Embodiment is nearly the same as that in the First Embodiment, the description is omitted here for the sake of simplicity.

TABLE 2

| | D.C. voltage of developing bias voltage |
|---|---|
| Image forming apparatus (f) Vf = 300 mm/sec | −450 V when toner remaining amount W > 300 g and −500 V when W ≦ 300 g |
| Image forming apparatus (s) Vs = 200 mm/sec | −450 V irrespective of toner remaining amount W |

Figure 6:
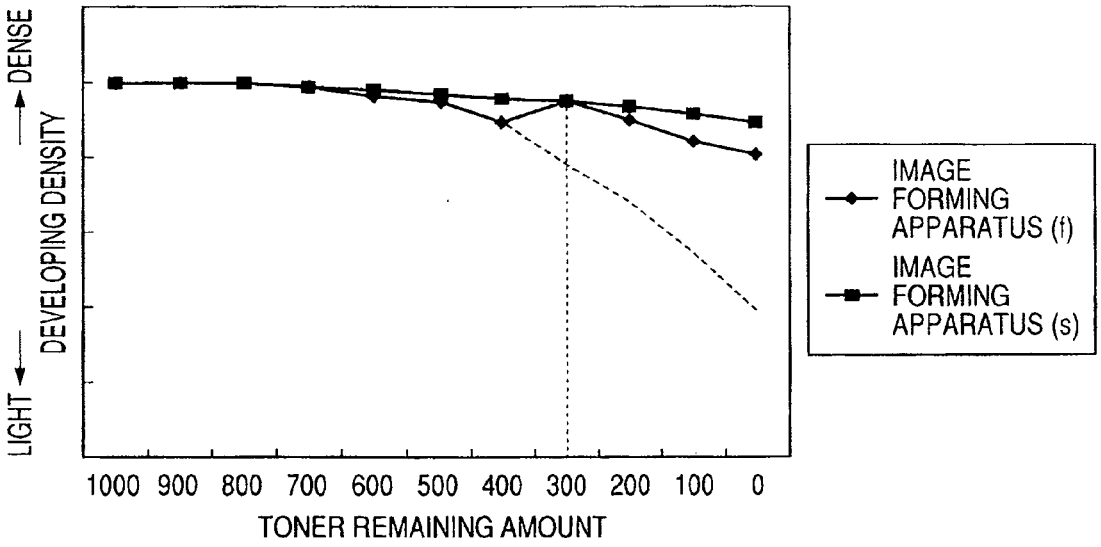
FIG. 6 is a graphical representation showing a change in image density when a control flow is carried out according to the Second Embodiment of the present invention.

Increasing the electric potential difference (the so-called developing contrast) between the electric potential of the D.C. voltage of the developing bias voltage and the electric potential in an image portion on the surface of the photosensitive member 1 increases the developing property to increase the image density. Consequently, when the amount of used toners becomes large and hence the difference in image density between the image forming apparatuses (f) and (s) becomes large, control is carried out such that the difference in D.C. voltage of the developing bias voltage between the image forming apparatuses (f) and (s) becomes large, and at this time, the D.C. voltage of the developing bias voltage of the image forming apparatus (f) becomes larger than that of the image forming apparatus (s), whereby the difference in image density between the image forming apparatuses (f) and (s) can be reduced similarly to the case where the peak-to-peak voltage of the A.C. voltage of the developing bias voltage is changed. Carrying out the above-mentioned control makes it possible to reduce the difference in image density between the image forming apparatuses (f) and (s) as shown in FIG. 6. Note that the D.C. voltage of the developing bias voltage is especially effective for satisfactory reproduction of a line width of a line image rather than the image density. Since the peak-to-peak voltage of the A.C. voltage of the developing bias voltage exerts a large influence on the image density, the peak-to-peak voltage is preferably changed for the image density.

In addition, in the Second Embodiment, the peak-to-peak voltages of the A.C. voltages of the developing bias voltages are held at the same value, i.e., at −450 V in both the image forming apparatuses (f) and (s) until an amount of used toners in the process cartridge becomes a predetermined value, to be specific, until a toner remaining amount W reaches 300 g. Thus, this is preferable since even when the process cartridge is mounted to either the image forming apparatus (f) or (s) in a state where the image density hardly undergoes the influence of the process speed at the beginning of use of the process cartridge, the densities of the output images can be made equal to each other. But, in a range allowing a difference in image density, the peak-to-peak voltages of the A.C. voltages of the developing bias voltages at the beginning of use of the process cartridge in the image forming apparatuses (f) and (s) may be set to different values, respectively.

In addition, in the First Embodiment, in the case of the image forming apparatus (s), the peak-to-peak voltage of the A.C. voltage of the developing bias voltage is held at −450 V, i.e., the peak-to-peak voltage of the A.C. voltage of the developing bias voltage is not changed in correspondence to the amount of used toners. As a result, the cost required for the production can be reduced since the design and circuit for controlling the peak-to-peak voltage of the A.C. voltage of the developing bias voltage do not need to be provided in the image forming apparatus (s).

Third Embodiment

Figure 7:
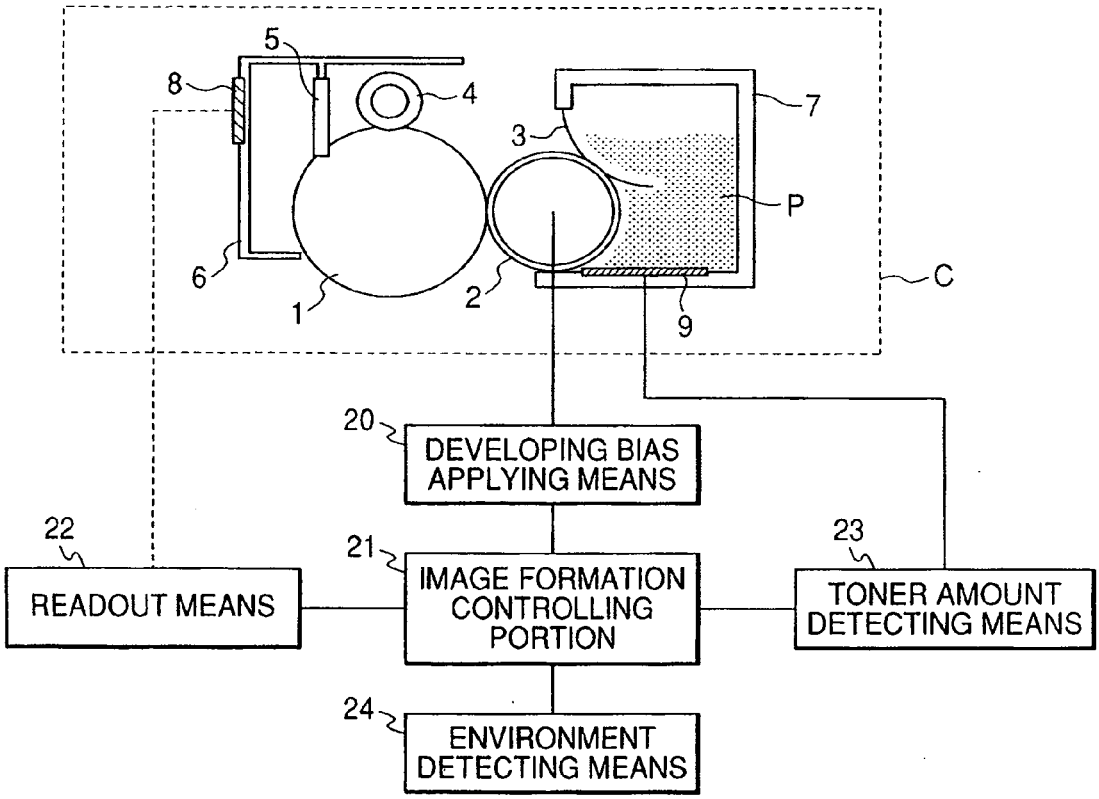
FIG. 7 is a schematic cross sectional view showing the construction of an image forming apparatus according to the Third Embodiment of the present invention.

In the Third Embodiment, environment detecting means 24 is provided in the image forming apparatus main body of the First or Second Embodiment (refer to FIG. 7) so that the control for the developing bias voltage can be carried out in correspondence to the environment as well. Note that since portions other than a characteristic portion have the same constructions as those in the First and Second Embodiments, their descriptions are omitted here for the sake of simplicity. In addition, the Third Embodiment will hereinafter be described based on the description of the First Embodiment.

Since the toner charging property or the like varies with the working environment, the image density level is influenced by the working environment. Since the absolute humidity of the air is high in a high-temperature environment, the charging property of the toners is reduced as compared with a case of a low temperature environment. For this reason, in the high-temperature environment, a phenomenon is caused in which the developing property is lowered and the image density is also reduced accordingly. Thus, when in the high-temperature environment, the process cartridge is changed and used between the image forming apparatuses which are different in their process speeds, the difference in developing density becomes remarkable. Consequently, the control is carried out so that the peak-to-peak voltage of the A.C. voltage of the developing bias voltage is changed in the high-temperature environment, while the developing bias voltage is not changed in the low-temperature environment. That is, when a property of the working environment falls within a predetermined range, different controls are carried out for information on the amount of consumption of developer between the first and second image forming apparatus main bodies. On the other hand, when the property of the working environment does not fall within the predetermined range, different controls are not carried out for the information on an amount of consumption of developer between the first and second image forming apparatus main bodies.

A voltage obtained by superposing a D.C. component of −450 V and a peak-to-peak voltage, 1,600 V, of an A.C.

voltage is applied as the standard voltage for the developing bias voltage to the developing roller 2 similarly to the case of the First Embodiment.

As for the control contents, when an environmental temperature T (°C.) is equal to or higher than 28° C., and the toner remaining amount W is smaller than 300 g, the peak-to-peak voltage of the A.C. voltage of the developing bias voltage is changed from 1,600 V to 1,800 V. On the other hand, when W≧300 g, the peak-to-peak voltage of the A.C. voltage of the developing bias voltage is not changed. Also, when T<28° C., the developing bias voltage is not changed irrespective of a value of W.

Table 3 shows the control contents in the environmental temperature ranges in the Third Embodiment.

TABLE 3

| | Peak-to-peak voltage of A.C. voltage of developing bias voltage Temperature | |
|---|---|---|
| | T < 28° C. | 28° C. ≦ T |
| Image forming apparatus (f) Vf = 300 mm/sec | 1,600 V irrespective of toner remaining amount W | 1,600 V when toner remaining amount W > 300 g<br>1,800 V when W ≦ 300 g |
| Image forming apparatus (s) Vs = 200 mm/sec | 1,600 V irrespective of toner remaining amount W | 1,600 V irrespective of toner remaining amount W |

Figure 8:
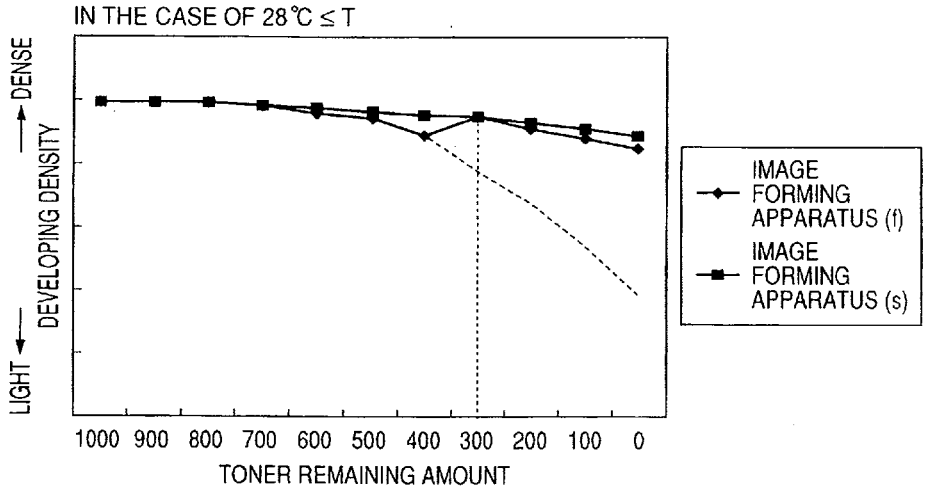
FIG. 8 is a graphical representation showing a change in image density when a control flow is carried out according to the Third Embodiment of the present invention (when $T \geqq 28°$ C.)
Figure 9:
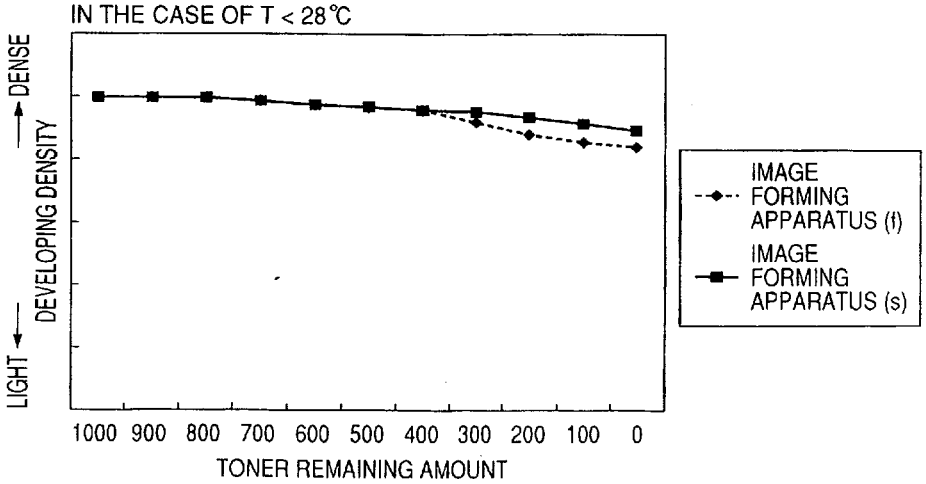
FIG. 9 is a graphical representation showing a change in image density when a control flow is carried out according to the Third Embodiment of the present invention (when $T < 28°$ C.)

The reduction of the image density due to the reduction of the toner charging property in the high-temperature environment as well as the reduction of the image density due to the amount of used toners can be effectively corrected in accordance with the above-mentioned control. A change in image density when the above-mentioned control is actually carried out is shown in FIG. 8 (in case of T≧28° C.) and in FIG. 9 (in case of T<28° C.). It is understood from FIGS. 8 and 9 that carrying out the above-mentioned control reduces the density difference between the image forming apparatuses (f) and (s).

Figure 10:
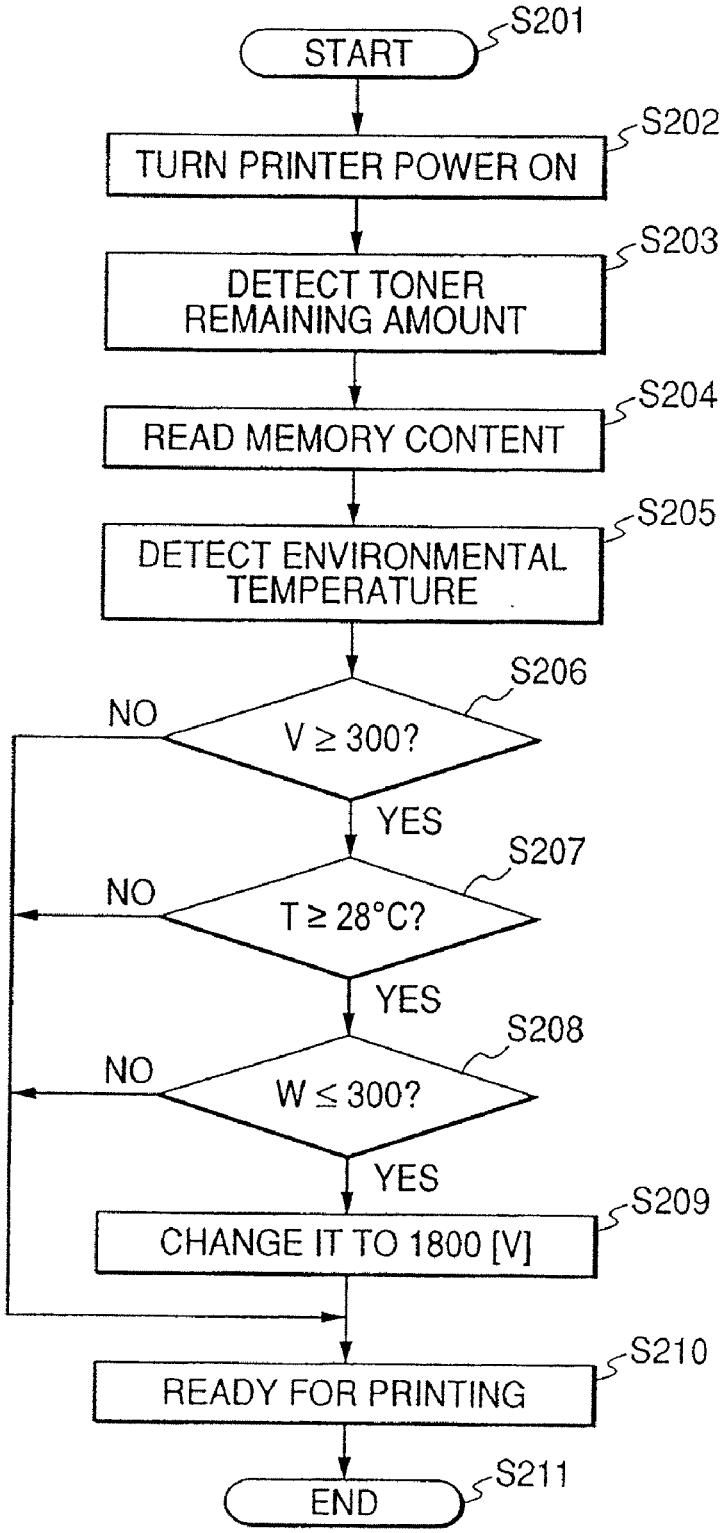
FIG. 10 is a flow chart showing a control flow according to the Third Embodiment of the present invention.

Next, a processing method will be described in brief with reference to a flow chart shown in FIG. 10.

An operation is started to be carried out (S201). When a power source of the printer is turned ON (S202), the toner remaining amount detecting means detects a toner remaining amount W in the process cartridge (S203) and at the same time, writes information on a toner remaining amount W to the storage medium. In addition, the readout means 22 provided on a side of the image forming apparatus main body accesses the storage medium mounted to the process cartridge to detect a toner remaining amount W in the process cartridge (S204). Also, the temperature detecting means detects an environmental temperature T (° C.). Such information is transmitted to the image formation controlling portion 21, and carries out the control corresponding to process speed information (S206), temperature information (S207), and a toner remaining amount W (S208). First of all, when the process speed V used for the image formation is judged to be lower than 300 mm/sec based on the previously stored process speed information, the image formation controlling portion 21 enters a print standby state without changing the developing bias voltage (S210). On the other hand, when the process speed V is judged to be equal to or higher than 300 mm/sec, the image formation controlling portion 21 processes the toner remaining amount detection results W (g), and the temperature detection results T (° C.) (S206). Next, when the environmental temperature T is judged to be lower than 28° C., the developing bias voltage is not changed. On the other hand, when the environmental temperature T is judged to be equal to or higher than 28° C., in a case where a toner remaining amount W is judged to be equal to or smaller than 300 g, the image formation controlling portion 21 changes the peak-to-peak voltage of the developing bias voltage to 1,800 V (S209) to enter a print standby state (S210). On the other hand, in a case where a toner remaining amount W is judged to be larger than 300 g, the developing bias voltage is not changed and the image formation controlling portion 21 enters the standby state (S210), thereby completing the operation (S211).

In the above-mentioned control, the number of environmental temperature thresholds and a value thereof with which the developing bias voltage is changed may be individually set based on a combination of the capacity of the process cartridge and the process speed of the image forming apparatus. Thus, the above values are merely given as an example in the image forming apparatus group used in the Third Embodiment, and hence the present invention is not especially limited thereto. In addition, while in the Third Embodiment, the temperature detecting means is used as the environment detecting means 24, the control may also be carried out using humidity detecting means.

The difference in the density between an image output from the image forming apparatus (f) and an image output from the image forming apparatus (s) can be reduced by providing the environment detecting means in the image forming apparatuses (f) and (s) as described above and by controlling the developing bias voltage.

Incidentally, in the image forming apparatus (s) whose reduction in the developing performance is small, the reduction in the developing performance depending on the environment is also small. Therefore, while the image forming apparatus (s) may have the environment detecting means, the image forming apparatus (s) need(s) not have the environment detecting means. There is often no need to control the developing bias voltage in accordance with the environment in the image forming apparatus (s). Thus, by changing the developing bias voltage with respect to the image forming apparatus (f) whose reduction in the developing performance is large, in particular in view of the influence of the environment, the difference in the density between an image output from the image forming apparatus (f) and an image output from the image forming apparatus (s) can be reduced without providing a complicated control sequence in the image forming apparatus (s).

Fourth Embodiment

The Fourth Embodiment is constituted such that two kinds of process cartridges can be mounted to two kinds of image forming apparatuses different in their process speeds. The two kinds of process cartridges are different in toner capacity when the developing apparatus is unused (hereinafter referred to as "a toner capacity"), and are identical in items other than the toner capacity. The two kinds of process cartridges can be mounted and used in the two kinds of image forming apparatuses different in their process speeds, respectively. Also, a combination thereof can also be changed in the middle of the use. Since items in the Fourth Embodiment are the same as those in the First Embodiment except for the bias application conditions and the like, a description with respect to the common portions is omitted here for the sake of simplicity.

In the Fourth Embodiment, there are two kinds of process cartridges. Then, a process cartridge (a) has a developing apparatus as a first developing apparatus in which the toner capacity Ma when the developing apparatus is unused is 1,000 g, and a process cartridge (b) has a developing apparatus as a second developing apparatus in which the toner capacity Mb when the developing apparatus is unused is 500 g. In addition, in the Fourth Embodiment, there are two kinds of image forming apparatuses: the image forming apparatus (f) as a first image forming apparatus having the process speed of Vf=300 mm/sec; and the image forming apparatus (s) as a second image forming apparatus having the process speed of Vs=200 mm/sec.

In such an image forming apparatus group, there are four working combinations of the two kinds of process cartridges and the two kinds of image forming apparatuses, and hence their image density levels accompanying the use thereof are different from one another. As previously stated in the section entitled Related Background Art, as the process speed is higher, it is easier for the image forming apparatus to be influenced by the long term change of the toners due to the reduction of the developing property, and hence the reduction of the image density accompanying that influence is large. The influence of the long term change of the toners becomes large when the process speed exceeds 300 mm/sec. In addition, since a period of time when the process cartridge undergoes the selection phenomenon becomes longer as the toner capacity when the developing apparatus is unused is larger, the reduction in image density level becomes remarkable. That reduction in image density level becomes remarkable when the toner capacity exceeds 1,000 g.

Figure 11A:
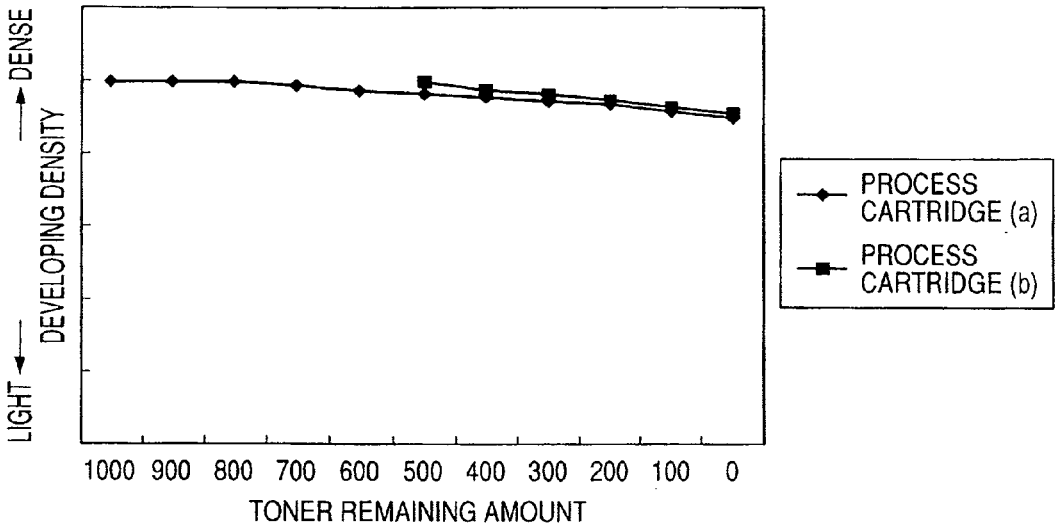
FIG. 11A is a graphical representation showing a change in developing density when a process cartridge (a) or (b) is mounted to a second image forming apparatus.
Figure 11B:
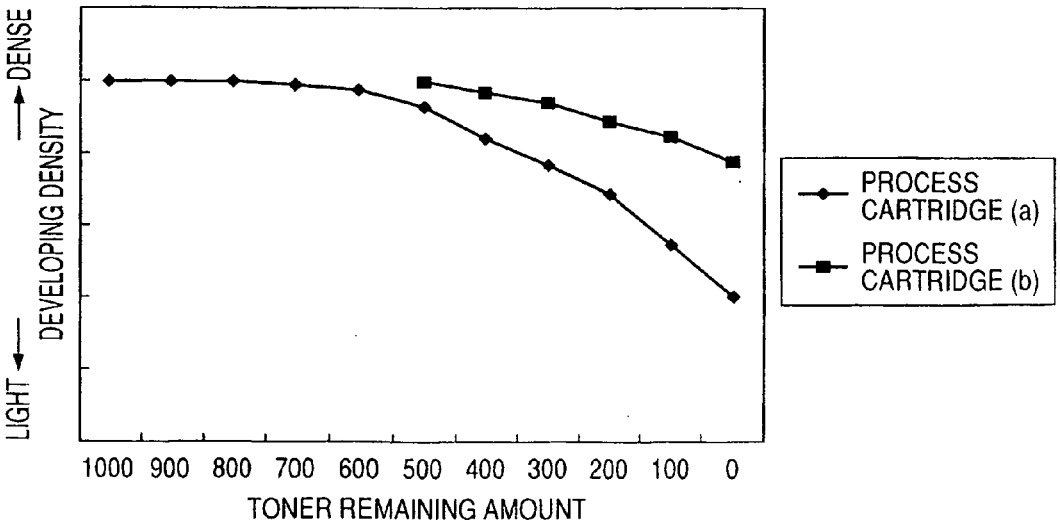
FIG. 11B is a graphical representation showing a change in developing density when the process cartridge (a) or (b) is mounted to a first image forming apparatus.
Figure 12A:
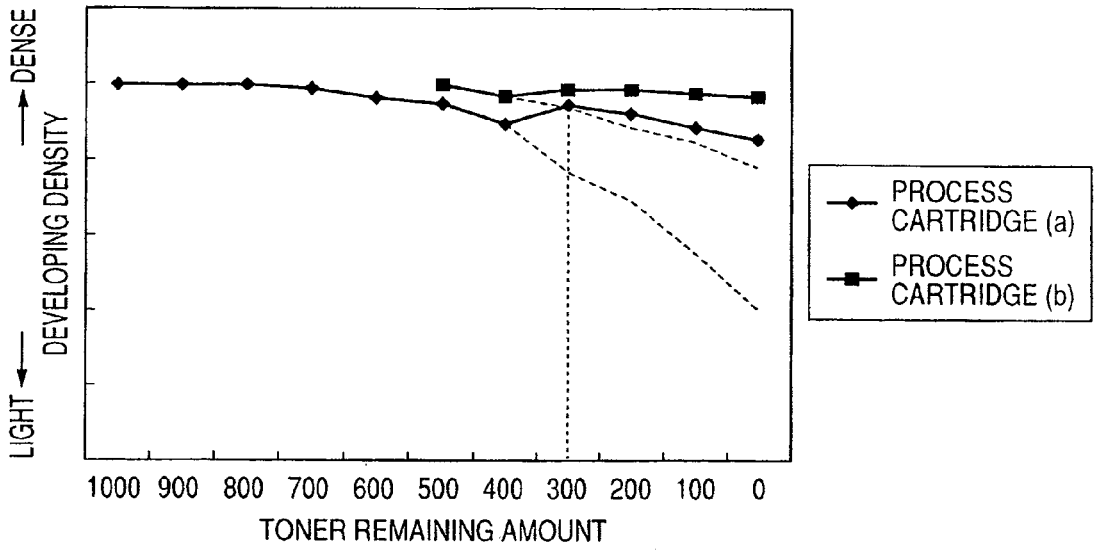
FIG. 12A is a graphical representation showing a change in developing density when a developing bias voltage is controlled in correspondence to a toner remaining amount in each of a case of the process cartridge (a) and a case of the process cartridge (b), when the process cartridge (a) or (b) is mounted to the first image forming apparatus.
Figure 12B:
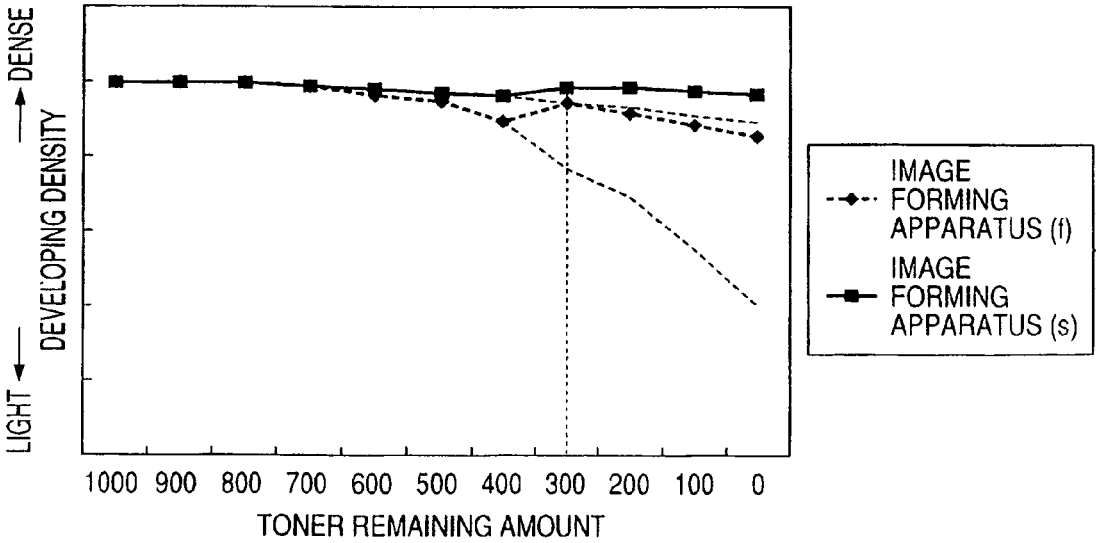
FIG. 12B is a graphical representation showing a change in developing density when a developing bias voltage is controlled in correspondence to a kind of process cartridge (toner capacity) and a toner remaining amount, when the process cartridge (a) is mounted to the first or second image forming apparatus.
Figure 12C:
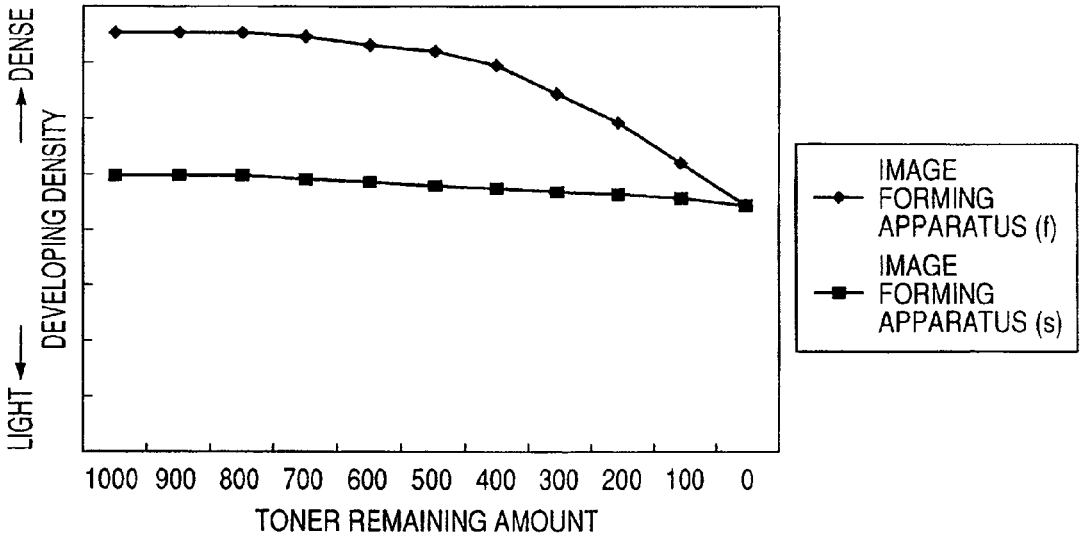
FIG. 12C is a graphical representation showing a change in developing density in a case where a set value of a developing bias voltage in the first image forming apparatus is made high when the process cartridge (a) is mounted to the first or second image forming apparatus.

FIGS. 11A and 11B show changes in image density when the two kinds of process cartridges are used in the image forming apparatuses (s) and (f), respectively. As previously stated, when an process cartridge is used in the image forming apparatus (s) having a relatively low process speed, since the reduction in image density due to the long term change of the toners is small and also the process speed is relatively low, a high developing property is obtained. Thus, there is no difference in image density level between the two kinds of process cartridges, and hence the excellent image is obtained. On the other hand, when the process cartridge is used in the image forming apparatus (f) having the process speed of 300 mm/sec, the long term change of the toners exerts a large influence on the image density, and there is also an influence of the reduction in developing property due to the increased process speed. Thus, the reduction in image density accompanying a decrease in toner remaining amount is observed in both the process cartridges, which leads to the formation of the faulty image. In addition, in a case of a combination of the large-capacity process cartridge (a) having the toner capacity of 1,000 g and the image forming apparatus (f), the reduction in image density level is remarkable. Thus, a difference in image density level between the process cartridges (a) and (b) becomes larger along with a decrease in toner remaining amount. In FIG. 11B, when the developing bias voltage in the process cartridge (a) is changed so as for its A.C. amplitude to become large in correspondence to a toner remaining amount, the same change is applied to the process cartridge (b) as well. Thus, a difference in image density level between the process cartridges (a) and (b) is not canceled (refer to FIG. 12A). In addition, when the amplitude of the A.C. voltage of the developing bias voltage is changed in correspondence to a kind of process cartridge (toner capacity) and a toner remaining amount in FIG. 11B, in the case of the process cartridge (a), for example, as shown in FIG. 12B, the difference in image density level between the image forming apparatuses (f) and (s) is not canceled. On the other hand, in the case where the initial setting of the amplitude of the A.C. voltage of the developing bias voltage is changed in correspondence to a kind of image forming apparatus (process speed) in FIG. 12B, for example, when an initial set value in the image forming apparatus (f) is made large, though at the end of the use, the same image density is obtained between the image forming apparatuses (f) and (s) as shown in FIG. 12C, at the beginning of the use, a difference in image density level is generated between the image forming apparatuses (f) and (s).

In order to solve the problem in the above-mentioned image forming system, the Fourth Embodiment provides an image forming system in which no large difference in image density level is generated without forming the faulty image even in all the combinations of the process cartridges and the image forming apparatuses. In order to attain this, the A.C. component and the D.C. component of the developing bias voltage are changed in correspondence to "the toner capacity" as a developer amount existing when the developing apparatus is unused, "a toner remaining amount," remaining in the developing apparatus, as the information on an amount of consumption of developer, and "the process speed" of the image forming apparatus.

More specifically, as shown in FIG. 1, the memory medium in which electronic information on the toner capacity and a toner remaining amount is stored is mounted to each of the process cartridges. The image forming apparatus main body includes the readout means 22 accessible to the memory medium. The information on the toner capacity and an amount of remaining toner is stored in the memory medium in such a manner, whereby even when the combination is changed in the middle of the use, an excellent image can be obtained without fluctuation of the image density level. In addition, the image forming apparatus main body includes the toner amount detecting means 23 for detecting a toner remaining amount by detecting a current which is induced in the electrode member 9 in correspondence to a toner amount between the developing roller 2 and the electrode member 9. The image formation controlling portion 21 changes the developing bias voltage as the developing conditions in correspondence to that information and the information on the process speed during image formation. Thus, the optimal developing bias voltage is applied from the developing bias applying means 20 to the developing roller 2.

In the Fourth Embodiment, a developing bias voltage which is obtained by superposing a D.C. component of −450 V and an A.C. component which has a rectangular waveform and which is 1,600 V in peak-to-peak voltage of an A.C. Voltage, 2,600 Hz in frequency, and 50% in duty ratio is set as a standard voltage in each of the image forming apparatuses (f) and (s). At this time, a gap provided between the photosensitive member 1 and the developing roller 2 is 300 μm. This gap is set so that an electric potential in a light portion on the surface of the photosensitive member 1 is made −600 V by the charging means. Setting the developing bias voltages to the same value in the process cartridges when the developing apparatuses are unused is preferable since the image densities at the beginning stage can be held at the same value.

Next, as for the control contents of the developing bias voltage, there is given a working combination of the process cartridge (a) and the image forming apparatus (f). In this case, when a toner remaining amount W falls within a range of 200 g<W≦300 g, the peak-to-peak voltage of the developing bias voltage as the standard voltage is changed to 1,800 V, while when a toner remaining amount W falls within a range of W≦200 g, the peak-to-peak voltage of the developing bias voltage is changed to 2,000 V.

In addition, in a case of a combination of the process cartridge (b) and the image forming apparatus (f), when a toner remaining amount W falls within a range of W≦200 g, the peak-to-peak voltage of the developing bias voltage as the standard voltage is changed to 1,800 V.

For example, when the process cartridge (a) is changed and used in the image forming apparatus (s) in a state where a toner remaining amount W is used up to 250 g in the case of the combination of the process cartridge (a) and the image forming apparatus (f), and the peak-to-peak voltage of the developing bias voltage applied from the image forming apparatus (f) to the process cartridge (a) is 1,800 V, the developing bias voltage applied to the process cartridge (a) is 1,600 V as the standard value. In addition, when as described above, the process cartridge (b) having a toner remaining amount W larger than 200 g, or the process cartridge (a) having a toner remaining amount W larger than 300 g is mounted and used in the image forming apparatus (f) in which the peak-to-peak voltage of the developing bias voltage to be applied to the process cartridge (a) is changed to 1,800 V, the peak-to-peak voltage of the developing bias voltage is returned back to 1,600 V as the standard value.

Table 4 shows the control contents in the Fourth Embodiment.

TABLE 4

| | Peak-to-peak voltage of A.C. voltage of developing bias voltage | |
|---|---|---|
| | Process Cartridge (a) Ma = 1000 g | Process Cartridge (b) Mb = 500 g |
| Image forming apparatus (f) Vf = 300 mm/sec | 1,600 V when toner remaining amount W > 300 g<br>1,800 V when 300 g ≧ W > 200 g<br>2,000 V when W ≦ 200 g | 1,600 V when toner remaining amount W > 200 g<br>2,000 V when W ≦ 200 g |
| Image forming apparatus (s) Vs = 200 mm/sec | 1,600 V irrespective of toner remaining amount W | 1,600 V irrespective of toner remaining amount W |

Figure 13:
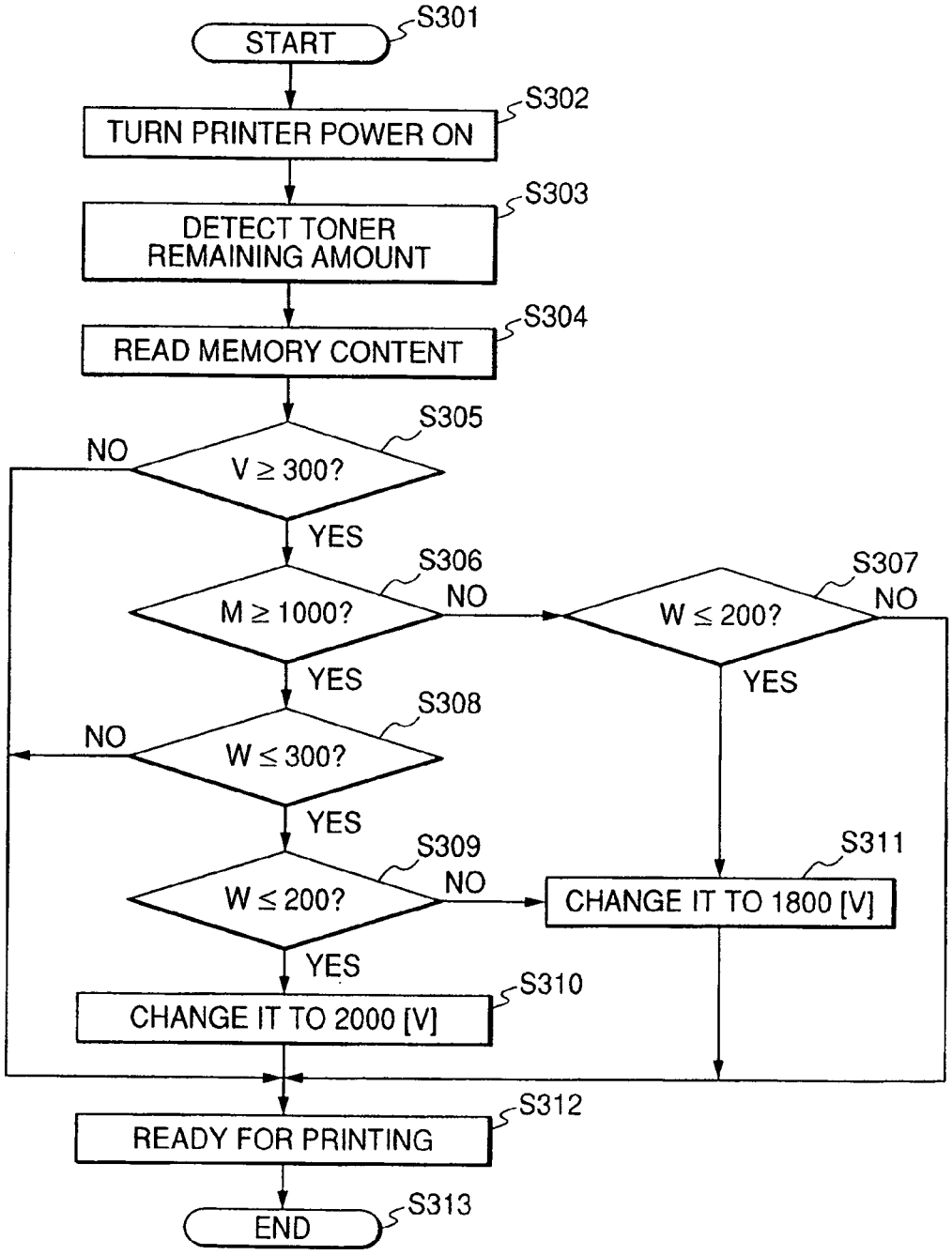
FIG. 13 is a flow chart showing a control flow according to the Fourth Embodiment of the present invention.

Next, a processing method will be described in brief with reference to a flow chart shown in FIG. 13.

An operation is started to be carried out (S301). When a power source of the printer is turned ON (S302), the toner remaining amount detecting means detects a toner remaining amount W in the process cartridge (S303). In addition, the readout means 22 provided on a side of the image forming apparatus main body accesses the storage medium mounted to the process cartridge to detect a toner remaining amount W in the process cartridge (S304). Such information is transmitted to the image formation controlling portion 21. First of all, when the process speed V used for the image formation is judged to be lower than 300 mm/sec based on the previously stored process speed information, the image formation controlling portion 21 enters a print standby state without changing the developing bias voltage (S312). On the other hand, when the process speed V is judged to be equal to or higher than 300 mm/sec, the image formation controlling portion 21 executes a processing corresponding to toner remaining amount detection results and toner capacity information (S305). Next, the method determines whether M≧1,000 g (S306) and whether M<1,000 g (S307) and based on the toner capacity information, those processings are executed based on the toner remaining amount information. In case of M≧1,000 g, when W>300 g, the developing bias voltage is not changed. When 200 g<W≦300 g (S308 and S309), the image formation controlling portion 21 changes the peak-to-peak voltage of the A.C. voltage of the developing bias voltage to 1,800 V (S311). Also, when W≦200 g, the image formation controlling portion 21 changes the peak-to-peak voltage of the A.C. voltage of the developing bias voltage to 2,000 V (S310) to enter the print standby state (S311). On the other hand, in case of M<1,000 g, when W>200 g, the developing bias voltage is not changed. When W≦200 g, the image formation controlling portion 21 changes the peak-to-peak voltage of the developing bias voltage to 1,800 V (S311) to enter the print standby state (S312), thereby completing the operation (S313).

The above-mentioned process flow is carried out when the process cartridge is mounted to or detached from the image forming apparatus main body as well as when the printer power source is turned ON. Hence, even when the use of the process cartridge is changed to the different image forming apparatus in the middle of being used, the optimal developing bias voltage can be applied to the developing roller 2.

Similarly to the case of the First Embodiment, when the toner remaining amount becomes smaller, i.e., when the amount of used toners becomes large, the difference in image density due to a difference in process speed can be reduced by changing the difference in peak-to-peak voltage of the A.C. voltage of the developing bias voltage between the image forming apparatuses (f) and (s) different in their process speeds in accordance with the above-mentioned control.

A consideration will hereinafter be made with respect to a case where the process cartridges are different in "toner capacity" and the image forming apparatuses are also different in "process speed." A consideration will now be made with respect to a case where, for example, the process cartridges (a) and (b) are mounted to the image forming apparatus (f) or (s).

When the process cartridge (a) or (b) is mounted to the image forming apparatus (f) having the high "process speed," even when any of the process cartridges (a) and (b) is mounted thereto, the developing bias voltage is changed in correspondence to "a toner remaining amount." However, the process cartridges (a) and (b) are different in the timing of the change depending on the degree of a decrease in toner remaining amount, the magnitude of the developing bias voltage after the change, and the like. This is because the larger the toner capacity when the developing apparatus is unused, the larger becomes the reduction in image density due to the long term change of the toners when the amounts of remaining toners decrease to the same level between the process cartridges (a) and (b) (refer to FIG. 11B). For this reason, in the case of the process cartridge (a) which has the large "toner capacity" when the developing apparatus is unused, the timing of the change of the developing bias voltage starts a little early (when an amount of used toners is smaller, i.e., when a toner remaining amount is much). Thus, in a case where the toner remaining amount of the process cartridges (a) and (b) is identical, the developing bias voltage of the process cartridge (a) becomes larger than that of the process cartridge (b).

On the other hand, in a case where the process cartridge (a) or (b) is mounted to the image forming apparatus (s), even when any of the process cartridge (a) or (b) is mounted thereto, no developing bias voltage is changed in correspondence to "a toner remaining amount." This is because whether the toner capacity when the developing apparatus is unused is large or small, the reduction in image density due to a long term change does not change so much (refer to FIG. 11A). That is, in a case where there is need to change the developing bias voltage, i.e., in a case where "the process speed" of the image forming apparatus is high, when the developing bias voltage is intended to be changed, how to change the developing bias voltage is further changed in correspondence to "the toner capacity" when the developing apparatus is unused. On the other hand, in a case where there is no need to change the developing bias voltage, i.e., in a case where "the process speed" of the image forming apparatus is low, a fixed developing bias voltage is applied to the developing roller 2 irrespective of "the toner capacity" when the developing apparatus is unused. By carrying out the control in such a manner, in all the combinations of the process cartridges and the image forming apparatuses, the image densities can be made nearly equal to one another.

Figure 14:
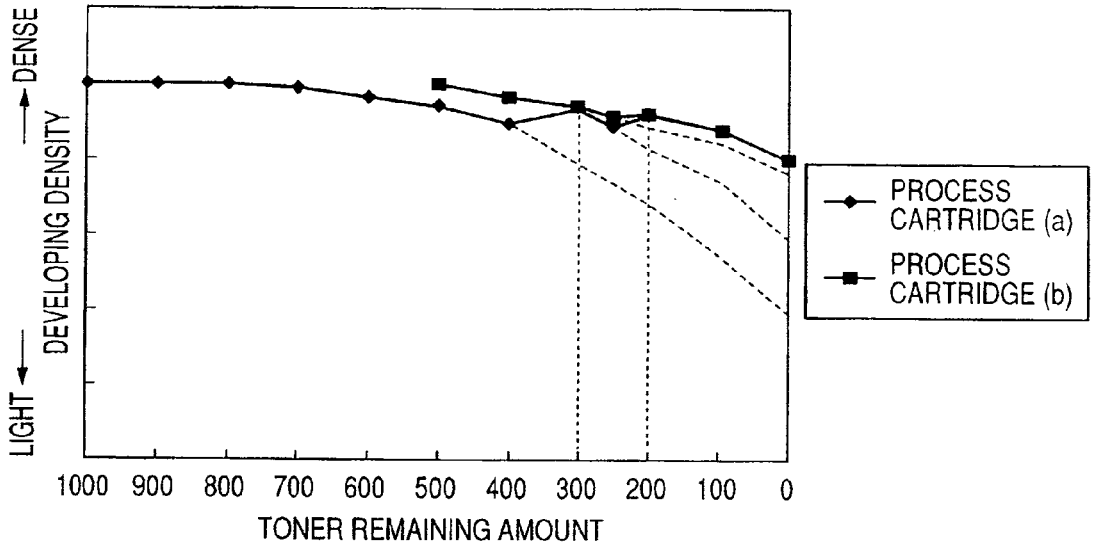
FIG. 14 is a graphical representation showing a change in image density in a case where a control flow according to the Fourth Embodiment of the present invention is carried out when the process cartridge (a) or (b) is mounted to the first image forming apparatus.
Figure 15:
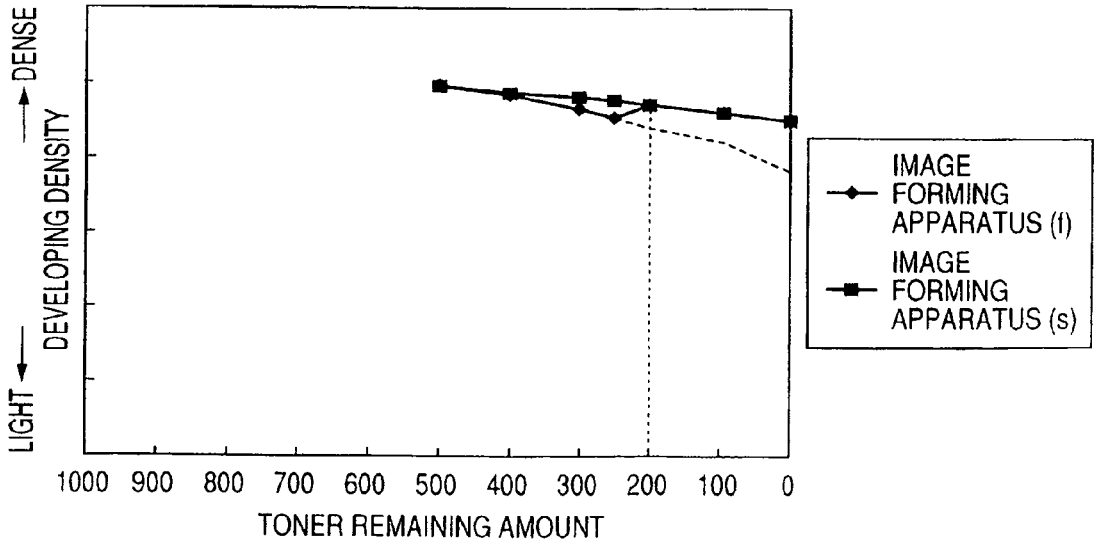
FIG. 15 is a graphical representation showing a change in image density in a case where the control flow according to the Fourth Embodiment of the present invention is carried out when the process cartridge (b) is mounted to the first or second image forming apparatus.
Figure 16:
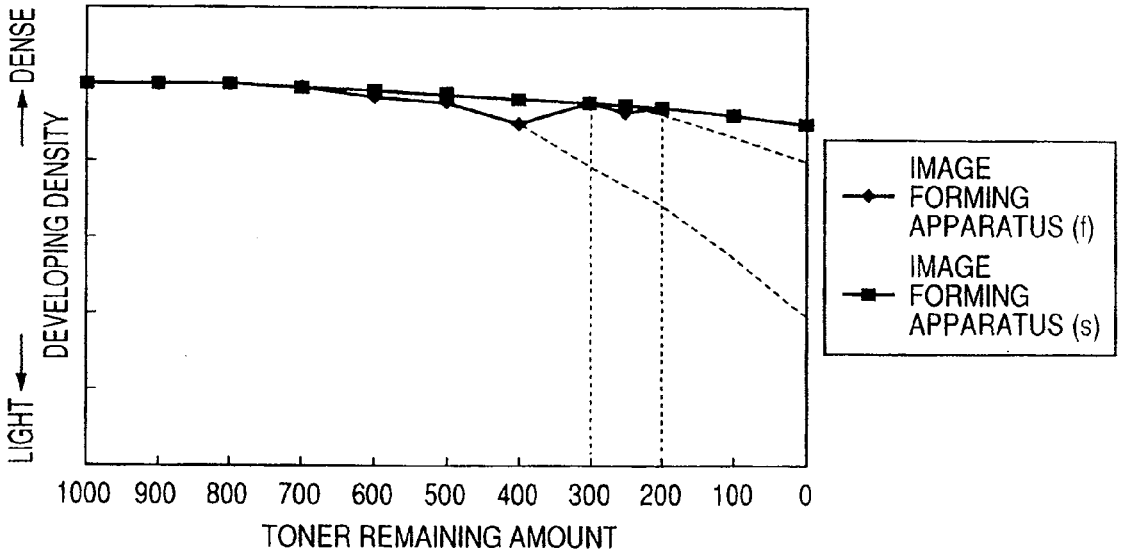
FIG. 16 is a graphical representation showing a change in image density in a case where the control flow according to the Fourth Embodiment of the present invention is carried out when the process cartridge (a) is mounted to the first or second image forming apparatus.

The reduction in image density due to the long term change of the toners can be effectively corrected through the above-mentioned control. In addition, it is possible to prevent formation of a fogged image due to the change of the developing bias voltage in an unsuitable situation. FIGS. 14 to 16 show changes in image density when the above-mentioned control is actually carried out. In all the combinations of the process cartridges (a) and (b), and the image forming apparatuses (f) and (s), the image density levels can be maintained nearly equal to one another, and thus the excellent images are obtained.

In the above-mentioned control, the values of the number of times of the change of the developing bias voltage, the timing (an amount of remaining toner), and the amplitude of the A.C. voltage can be individually set based on the combinations of the capacities of the process cartridges and the process speeds of the image forming apparatuses. Thus, those values are merely given as an example in the image forming system used in the Fourth Embodiment, and hence the present invention is not especially limited thereto. In addition, in the Fourth Embodiment, the developing conditions are changed by increasing the peak-to-peak voltage of the A.C. voltage of the developing bias voltage. Alternatively, however, an electric potential difference between the electric potential of the D.C. voltage of the developing bias voltage and the electric potential in the image portion on the surface of the photosensitive member may be increased by changing the D.C. voltage of the developing bias voltage. But, since the peak-to-peak voltage of the A.C. voltage of the developing bias voltage exerts a large influence on the image density, the peak-to-peak voltage is preferably changed.

In addition, the contents stored in the memory are not limited to only the toner capacities as in the Fourth Embodiment. That is, a method including storing information on a toner remaining amount in the process cartridge in the memory may also be adopted, or it is also possible to store a value calculated from the toner capacity and a toner remaining amount in the memory.

Moreover, while in the Fourth Embodiment, the developing bias voltage is changed step by step, the developing bias voltage may also be continuously changed in correspondence to a toner remaining amount. But, with respect to a timing at which the developing bias voltage is first changed from the initial state, in a plurality of image forming apparatuses, the image forming apparatus having the high process speed has a earlier timing (in a state where a toner remaining amount is much) than that of the image forming apparatus having the low process speed. In addition, when a plurality of image forming apparatuses are equal in toner remaining amount to one another, the magnitude of the developing bias voltage of the image forming apparatus having the high process speed becomes equal to or larger than that of the developing bias voltage of the image forming apparatus having the low process speed. This is because as described above, the reduction in image density due to the long term change of the toners in the image forming apparatus having the high process speed is larger than that in image density due to the long term change of the toners in the image forming apparatus having the low process speed.

With respect to the timing at which the developing bias voltage is firstly changed from the initial state, in a plurality of process cartridges, the process cartridge having the large toner capacity when the developing apparatus is unused has an earlier timing (in a state where the amount of remaining tones is substantially) than that in the process cartridge having the small toner capacity when the developing apparatus is unused. This is because as described above, the larger the toner capacity when the developing apparatus is unused is, the larger the becomes reduction in image density due to the long term change of the toners when the amounts of remaining toners decrease to the same level among a plurality of process cartridges.

Fifth Embodiment

A feature of the Fifth Embodiment is that the environment detecting means 24 capable of detecting a working environment of the image forming apparatus is provided in the image forming apparatus of the Fourth Embodiment, and the more detailed control is carried out by changing the peak-to-peak voltage of the developing bias voltage in correspondence to the detection results from the environment detecting means 24. Since elements other than the bias application conditions and the like are the same as those in the Fourth Embodiment, a description of the common elements is omitted here for the sake of simplicity.

This is because since the toner charging property or the like varies with the working environment and thus the image density level undergoes an influence of the working environment, the image density level undergoes an influence of the working environment.

Then, the fifth Embodiment provides an image forming system adopting a method including controlling the developing bias voltage in correspondence to "an environment" as well in addition to the method including controlling the developing bias voltage in correspondence to "the process speed," "the toner capacity," and "a toner remaining amount" as described in the Fourth Embodiment, thereby allowing a plurality of process cartridges different in toner capacity and a plurality of image forming apparatuses different in their process speeds to be arbitrarily combined, in which even when an environmental change occurs in the middle of the use, a difference in image density level can be maintained nearly constant.

When, for example, in the image forming system including the same process cartridges and image forming apparatuses as those described in the Fourth Embodiment, the image forming apparatus (f) combined with the process cartridge (a) is used in environments different in ambient temperature, a large difference in image density level occurs. When there are many working environments, the environment detecting means needs to be provided in the image forming apparatus main body or in the process cartridge to detect the environment, thereby controlling the developing bias voltage in correspondence to the detected environment.

More specifically, there is given a control method in which threshold information on environmental temperatures is stored in the image formation controlling portion 21, and the peak-to-peak voltage of the developing bias voltage is changed in correspondence to "the process speed," "the toner capacity," "a toner remaining amount," and "an environmental temperature." In the case of the Fifth Embodiment, the developing bias voltage is controlled with threshold temperatures of 25° C. and 30° C. as a reference.

As for the control contents, in a case of a use combination of the process cartridge (a) and the image forming apparatus (f), when the environmental temperature T falls within a range of T≧30° C., and a toner remaining amount W falls within a range of 200 g<W≦300 g, the peak-to-peak voltage of the developing bias voltage is changed to 1,800 V. When T≧30° C. and W≦200 g, the peak-to-peak voltage of the developing bias voltage is changed to 2,000 V. When 25° C.≦T<30° C., and W≦200 g, the peak-to-peak voltage of the developing bias voltage is changed to 1,800 V. Also, when T<25° C., no developing bias voltage is changed irrespective of the value of W.

In addition, in a case of a use combination of the process cartridge (b) and the image forming apparatus (f), only when T≧30° C. and W≦200 g, the peak-to-peak voltage of the developing bias voltage is changed to 1,800 V. Moreover, in a case where each of the process cartridges (a) and (b) is used in the image forming apparatus (s), no developing bias voltage is changed irrespective of the values of T and W.

In addition, for example, in a state where under the environment having a working environmental temperature T of 30° C., in a combination of the process cartridge (a) and the image forming apparatus (f), the toners are used until a toner remaining amount W becomes 250 g, and the peak-to-peak voltage of the developing bias voltage applied from the image forming apparatus (f) to the process cartridge (a) is 1,800 V, when this image forming system is moved from that working environment to a working environment having the working environmental temperature T of 20° C., the developing bias voltage to be applied from the image forming apparatus (f) to the process cartridge (a) is returned back to 1,600 V as a standard value. This is because a phenomenon occurs in which the charging property of the toners in a high temperature environment deteriorates as compared with the case in a low temperature environment. That is, in the high temperature environment, the developing property deteriorates and hence the image density is reduced accordingly.

The reduction in image density due to the deterioration of the toner charging property caused under the high temperature environment as well as the reduction in image density due to the long term change of the toners can be effectively corrected by carrying out the above-mentioned control. When the above-mentioned control is actually carried out, in all the combinations of the process cartridges (a) and (b), and the image forming apparatuses (f) and (s), the image density levels can be maintained nearly equal to one another, and hence the excellent images can be obtained.

Tables 5 to 7 show the control contents in respective environmental temperature ranges.

TABLE 5

| Environmental temperature T: T ≧ 30° C. | | |
|---|---|---|
| | Process Cartridge (a) Ma = 1000 g | Process Cartridge (b) Mb = 500 g |
| Image forming apparatus (f) Vf = 300 mm/sec | 1,600 V when toner remaining amount W > 300 g<br>1,800 V when 300 g ≧ W > 200 g<br>2,000 V when W ≦ 200 g | 1,600 V when toner remaining amount W > 200 g<br>1,800 V when W ≦ 200 g |
| Image forming apparatus (s) Vs = 200 mm/sec | No change 1,600 V irrespective of W (g) | No change 1,600 V irrespective of W |

TABLE 6

| Environmental temperature T: 25° C. ≦ T < 30° C. | | |
|---|---|---|
| | Process Cartridge (a) Ma = 1000 g | Process Cartridge (b) Mb = 500 g |
| Image forming apparatus (f) Vf = 300 mm/sec | 1,600 V when toner remaining amount W > 200 g<br>1,800 V when W ≦ 200 g | No change 1,600 V irrespective of W (g) |
| Image forming apparatus (s) Vs = 200 mm/sec | No change 1,600 V irrespective of W | No change 1,600 V irrespective of W |

TABLE 7

| Environmental temperature T: T < 25° C. | | |
|---|---|---|
| | Process Cartridge (a) Ma = 1000 g | Process Cartridge (b) Mb = 500 g |
| Image forming apparatus (f) Vf = 300 mm/sec | No change 1,600 V irrespective of W (g) | No change 1,600 V irrespective of W |
| Image forming apparatus (s) Vs = 200 mm/sec | No change 1,600 V irrespective of W | No change 1,600 V irrespective of W |

Figure 17:
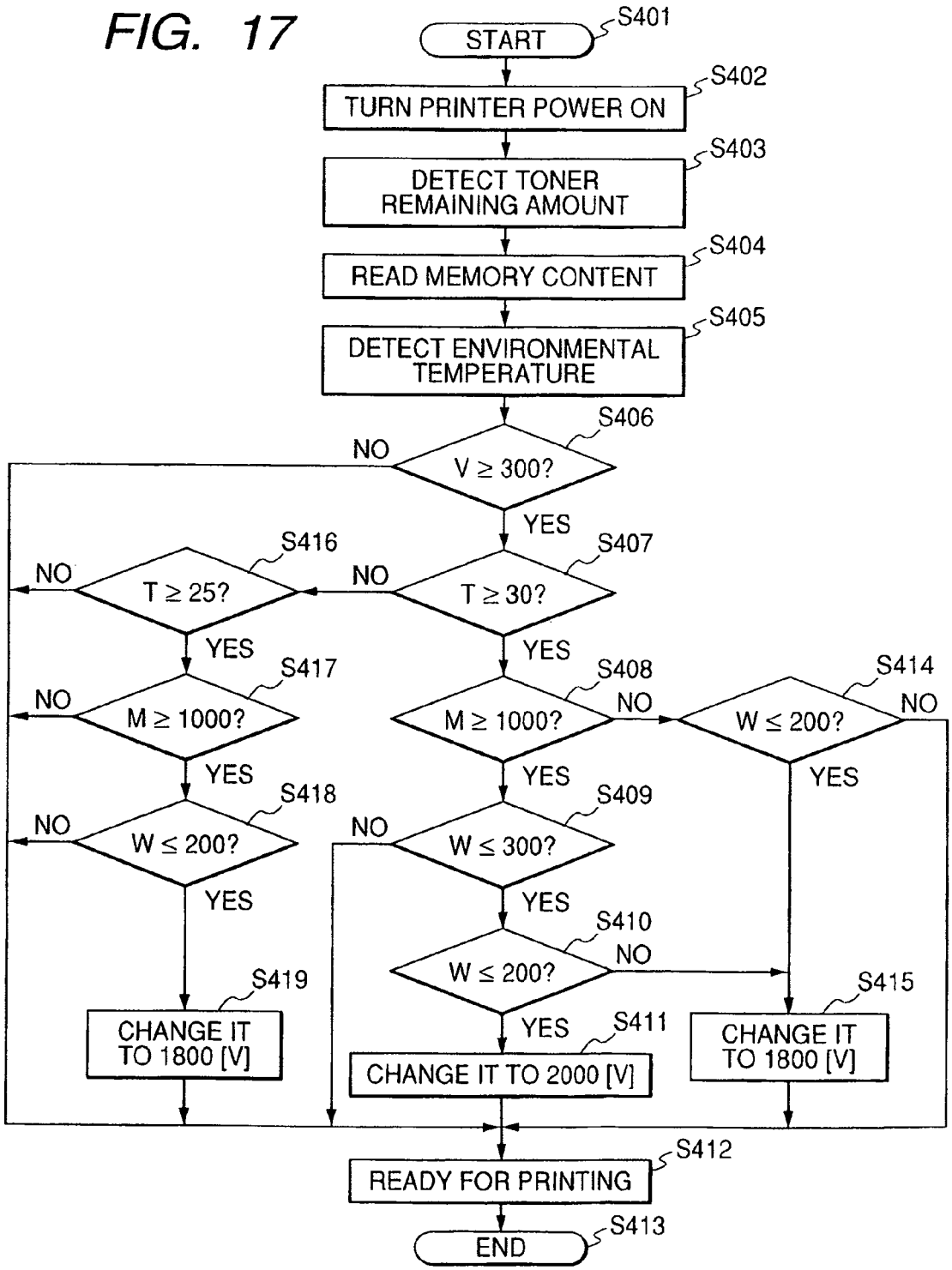
FIG. 17 is a flow chart showing a control flow according to the fifth Embodiment of the present invention.

Next, a processing method will be described in brief with reference to a flow chart shown in FIG. 17.

An operation is started to be executed (S401). When the printer power source is turned ON (S402), the toner remaining amount detecting means detects a toner remaining amount W in the process cartridge (S403). The readout means 22 provided on the side of the image forming apparatus main body accesses the memory medium mounted to the process cartridge to detect the toner capacity M of the process cartridge (S404). Then, the temperature detecting means detects the environmental temperature T (S405). Such information is transmitted to the image formation controlling portion 21. First of all, when the process speed V used for the image formation is judged to be lower than 300 mm/sec based on the process speed information previously stored in the memory medium, the image formation controlling portion 21 enters the print standby state without changing the developing bias voltage (S412) On the other hand, when V≧300 mm/sec, the image formation controlling portion 21 executes a processing corresponding to the toner remaining amount detection results W, the toner capacity information M, and the temperature detection results T (S406). Next, when the environmental temperature T is judged to be lower than 25° C. (S407 and S416), the developing bias voltage is not changed. On the other hand, when 25° C.≦T<30° C., in a case of M≧1,000 g and W≦200 g (S417 and S418), the image formation controlling portion 21 changes the peak-to-peak voltage of the developing bias voltage to 1,800 V (S419) to enter the print standby state (S412). In a case of M<1,000 g, or W>200 g, the developing bias voltage is not changed. In addition, when T≧30° C. (S407), in a case of M≧1000 g (S408), and W≦200 g (S409 and S410), the image formation controlling portion 21 changes the peak-to-peak voltage of the developing bias voltage to 2,000 V (S411). Also, in a case of M≧1,000 g (S408), and 200 g<W≦300 g (S409 and S410), and in a case of M<1,000 g and W≦200 g (S414), the image formation controlling portion 21 changes the peak-to-peak voltage of the developing bias voltage to 1,800 V (S415) to enter the print standby state (S412), thereby completing the operation (S413).

In the above-mentioned control, the number of environmental temperature thresholds and the values thereof with which the developing bias voltage is to be changed can be individually set based on the combinations of the capacities of the process cartridges and the process speeds of the image forming apparatuses. Thus, those values are merely given as an example in the image forming system used in the Fifth Embodiment, and hence the present invention is not especially limited thereto. In addition, while in the Fifth Embodiment, the temperature detecting means is used as the environment detecting means 24, humidity detecting means is added to the image forming system used in the Fifth Embodiment so that the more detailed control may be carried out. But, for the same process cartridge, with respect to a timing at which the developing bias voltage is firstly changed from the standard voltage, the process cartridge used at the higher environmental temperature has an earlier timing (a timing at which an amount of used toners is smaller, i.e., a timing at which a toner remaining amount is substantial) than that in the process cartridge used at the lower environmental temperature. For example, in the Fifth Embodiment, when 25° C.≦T<30° C., in a case where a toner remaining amount W is 200 g, the developing bias voltage is changed, while when T≧30° C., in a case where a toner remaining amount W is 300 g, the developing bias voltage is changed. This is because as previously described, the image density is easier to reduce in the environment at the high temperature as compared with the case of the environment at the low temperature.

In addition, in the Fifth Embodiment, the peak-to-peak voltage of the A.C. voltage of the developing bias voltage is changed. Alternatively, however, the control may also be carried out in which an electric potential difference between the electric potential of the D.C. voltage of the developing bias voltage, and the electric potential in the image portion on the surface of the photosensitive member 1 is increased by changing the D.C. voltage of the developing bias voltage.

The First to Fifth Embodiments are supplemented as follows.

In the First to Fifth Embodiments, the method including measuring a toner remaining amount in the toner container is used in order to judge the amount of used toners. This reason for using this method is that measuring directly a toner remaining amount makes it possible to know the amount of used toners with high accuracy. However, in addition thereto, any other technique may be utilized as long as an amount of consumption of developer can be judged by utilizing this technique. For example, an amount of used toners can be measured based on an accumulated value of a pixel counting for the image formation, or based on an accumulated value of the number of the recording sheets each having an image formed thereon. Note that the use of the pixel counting is preferable rather than the use of the image-formed recording sheet number since the amount of used toners can be measured with high accuracy in the case of the use of the pixel counting.

This application claims priorities from Japanese Patent Application Nos. 2004-033508 filed on Feb. 10, 2004 and 2005-023509 filed on Jan. 31, 2005 which are hereby incorporated by reference herein.

What is claimed is:

1. An image forming apparatus group for controlling first and second image forming apparatuses having different process speeds, said image forming apparatus group comprising:

an image bearing member;

a developer carrying member configured and positioned to develop an electrostatic latent image formed on said image bearing member using a developer and to receive a voltage comprising an A.C. voltage; and a developer container configured to contain the developer, wherein a cartridge including said developer carrying member and said developer container is provided detachably and commonly mountable to a main body of the first image forming apparatus and a main body of the second image forming apparatus, and wherein said image forming apparatus group increases the difference between a peak-to-peak voltage of the A.C. voltage in the main body of the first image forming apparatus, and a peak-to-peak voltage of the A.C. voltage in the main body of the second image forming apparatus as an amount of consumption of developer in the cartridge increases.

2. An image forming apparatus group according to claim 1, wherein the main body of the second image forming apparatus has a lower process speed than the main body of the first image forming apparatus, and the peak-to-peak voltage of the A.C. voltage in the main body of the first image forming apparatus is equal to or larger than that of the A.C. voltage in the main body of the second image forming apparatus.

3. An image forming apparatus group according to claim 2, wherein the peak-to-peak voltage of the A.C. voltage in the main body of the second image forming apparatus is constant irrespective of the amount of consumption of developer in the cartridge.

4. An image forming apparatus group according to claim 1, wherein said image forming apparatus group sets the peak-to-peak voltage of the A.C. voltage in the main body of the first image forming apparatus and the peak-to-peak voltage of the A.C. voltage in the main body of the second image forming apparatus to the same value until the amount of consumption of developer in the cartridge reaches a predetermined value.

5. An image forming apparatus group according to claim 1, wherein a voltage obtained by superimposing a D.C. voltage on the A.C. voltage is applied to said developer carrying member, and the D.C. voltage in the main body of the first image forming apparatus and the D.C. voltage in the main body of the second image forming apparatus are constant irrespective of the amount of consumption of developer in the cartridge.

6. An image forming apparatus group according to claim 1, wherein a D.C. voltage in the main body of the first image forming apparatus and a D.C. voltage in the main body of the second image forming apparatus are equal to each other irrespective of the amount of consumption of developer in the cartridge.

7. An image forming apparatus group for controlling first and second image forming apparatuses having different process speeds, said image forming apparatus group comprising:

an image bearing member;

a developer carrying member configured and positioned to develop an electrostatic latent image formed on said image bearing member using a developer, and to receive a voltage comprising a D.C. voltage; and a developer container configured to contain the developer, wherein a cartridge including said developer carrying member and said developer container is provided detachably and commonly mountable to a main body of the first image forming apparatus and a main body of the second image forming apparatus, and wherein said image forming apparatus group increases the difference between the D.C. voltage in the main body of the first image forming apparatus, and the D.C. voltage in the main body of the second image forming apparatus as an amount of consumption of developer in the cartridge increases.

8. An image forming apparatus group according to claim 7, wherein the main body of the second image forming apparatus has a lower process speed than the main body of the first image forming apparatus, and the D.C. voltage in the main body of the first image forming apparatus is equal to or larger than the D.C. voltage in the main body of the second image forming apparatus.

9. An image forming apparatus group according to claim 8, wherein the D.C. voltage in the main body of the second image forming apparatus is constant irrespective of the amount of consumption of developer in the cartridge.

10. An image forming apparatus group according to claim 7, wherein said image forming apparatus group sets the D.C. voltage in the main body of the first image forming apparatus and the D.C. voltage in the main body of the second image forming apparatus to the same value until the amount of consumption of developer in the cartridge reaches a predetermined value.

11. An image forming apparatus group for controlling first and second image forming apparatuses, where a process speed of the second image forming apparatus has a lower process speed than the first image forming apparatus, said image forming apparatus group comprising:

an image bearing member;

a developer carrying member configured and positioned to develop an electrostatic latent image formed on said image bearing member using a developer, and to receive a developing bias voltage; and a developer container configured to contain the developer, wherein a cartridge including said developer carrying member and said developer container is provided detachably and commonly mountable to a main body of the first image forming apparatus and a main body of the second image forming apparatus, and wherein said image forming apparatus group changes a magnitude of the developing bias voltage in the main body of the first image forming apparatus as an amount of consumption of developer in the cartridge increases, and said image forming apparatus group holds a magnitude of the developing bias voltage in the main body of the second image forming apparatus constant irrespective of the amount of consumption of developer in the cartridge.

12. An image forming apparatus group for controlling a first image forming apparatus and a second image forming apparatus whose process speed is lower than the first image forming apparatus, said image forming apparatus group comprising:

an image bearing member;

a developer carrying member configured and positioned to develop an electrostatic latent image formed on said image bearing member using a developer, and to receive a developing bias voltage; and a developer container configured to contain the developer, wherein a cartridge including said developer carrying member and said developer container is provided detachably and commonly mountable to a main body of the first image forming apparatus and a main body of the second image forming apparatus, wherein the main body of the first image forming apparatus and the main body of the second image forming apparatus carry out different control operations for the developing bias voltages, respectively, in accordance with the amount of consumption of developer in the cartridge, and wherein when the cartridge has the same amount of remaining developer, the magnitude of the developing bias voltage in the first image forming apparatus is equal to or larger than that of the developing bias voltage in the second image forming apparatus.

13. An image forming apparatus group for controlling a first image forming apparatus and a second image forming apparatus having a lower process speed than the first image forming apparatus, said image forming apparatus group comprising:

an image bearing member;

developer carrying members configured and positioned to develop an electrostatic latent image formed on said image bearing member using a developer, and to receive a developing bias voltage; and developer containers configured to contain the developer, wherein a plurality of kinds of cartridges each including one of said developer carrying members and one of said developer containers are provided detachably and commonly mountable to a main body of the first image forming apparatus and a main body of the second image forming apparatus, and the plurality of kinds of cartridges includes a first cartridge and a second cartridge, wherein the developer amount in the developer container of the second cartridge when the developer is unused is smaller than that in the developer container of the first cartridge when the developer is unused, wherein said image forming apparatus group applies different developing bias voltages to the developer carrying members of the first cartridge and the second cartridge when the first cartridge and the second cartridge are mounted to the main body of the first image forming apparatus in accordance with an amount of consumption of developer in the first and second cartridges, and wherein said image forming apparatus group applies equal developing bias voltages to the developer carrying members of the first cartridge and the second cartridge when the first cartridge and the second cartridge are mounted to the main body of the second image forming apparatus irrespective of the amount of consumption of developer in the first and second cartridges cartridge.

14. An image forming apparatus group according to claim 13, wherein the amount of consumption of developer when the developing bias voltage of the first cartridge mounted to the main body of the first image forming apparatus is first changed from the developing bias voltage when the first cartridge is unused is smaller than that when the developing bias voltage of the second cartridge mounted to the main body of the first image forming apparatus is first changed from the developing bias voltage when the second cartridge is unused.

15. An image forming apparatus group according to claim 14, wherein a developer amount Ma in the developer container of the first cartridge when the first cartridge is unused falls within a range of Ma≧1,000 g, and a developer amount Mb in the developer container of the second cartridge when the second cartridge is unused falls within a range of Mb<1,000 g.

16. An image forming apparatus group according to claim 1, 7, 11, or 12, wherein said image forming apparatus group determines the amount of consumption of developer based on detection results from developer amount detecting means for successively detecting a developer amount contained in the developer container of the cartridge.

17. An image forming apparatus group according to claim 1, 7, 11, 12, or 13, wherein said image forming apparatus group determines the amount of consumption of developer based on an accumulated value of pixel counting for image information for formation of the electrostatic latent image.

18. An image forming apparatus group according to claim 1, 7, 11, 12, or 13, wherein said image forming apparatus group determines the amount of consumption of developer based on an accumulated value of the number of sheets each having an image formed thereon.

19. An image forming apparatus group according to claim 1, 7, 11, 12, or 13, wherein the main body of the second image forming apparatus has a lower process speed than the main body of the first image forming apparatus, wherein the first image forming apparatus includes environment detecting means for detecting a parameter of the working environment, and when the detected parameter of the working environment falls within a predetermined range, said image forming apparatus group performs a predetermined control operation, while when the detected parameter of the working environment is outside of the predetermined range, said image forming apparatus group does not perform the predetermined control operation, and wherein the second image forming apparatus does not change the predetermined control operation in accordance with the working environment.

20. An image forming apparatus group according to claim 1, 7, 11, 12, or 13, wherein a process speed Vf of the first image forming apparatus falls within a range of Vf≧300 mm/sec, and a process speed Vs of the second image forming apparatus falls within a range of Vs<300 mm/sec.

21. An image forming apparatus group according to claim 1, 7, 11, or 12, wherein the cartridge further includes the image bearing member.

22. An image forming apparatus group according to claim 1, 7, 11, or 12, wherein the cartridge further includes a storage medium configured to store therein information on the amount of consumption of developer.

23. An image forming apparatus group according to claim 1, 7, 11, 12, or 13, wherein said image bearing member is a photosensitive member, and each of the first image forming apparatus and the second image forming apparatus includes charging means for charging said photosensitive member with electricity, an exposing device configured and positioned to expose said photosensitive member based on image information to form an electrostatic latent image on said photosensitive member, transfer means for transferring a developed image formed on said photosensitive member through development onto a transfer material, and fixing means for fixing a transferred developed image to the transfer material.

* * * * *

UNITED STATES PATENT AND TRADEMARK OFFICE

CERTIFICATE OF CORRECTION

PATENT NO. : 7,215,904 B2
APPLICATION NO. : 11/052525
DATED : May 8, 2007
INVENTOR(S) : Hideaki Hasegawa et al.

It is certified that error appears in the above-identified patent and that said Letters Patent is hereby corrected as shown below:

ON THE COVER PAGE

In the "(74) Attorney, Agent, or Firm" section, "Fitzpatricks, Cella, Harper & Scinto" should read --Fitzpatrick, Cella, Harper & Scinto--.

In the "(56) References Cited, Foreign Patent Documents, Page 2, "2002244382A" should read --2002-244382 A--.

In the "(57) Abstract" section, Line 7, "n" should be deleted.

COLUMN 2

Line 19, "arise" should read --arise.--.

COLUMN 13

Table 3,

TABLE 3

"

| | Peak-to-peak voltage of A.C. voltage of developing bias voltage Temperature | |
|---|---|---|
| | T < 28° C. | 28° C. ≦ T |
| Image forming apparatus (f) Vf = 300 mm/sec | 1,600 V irrespective of toner remaining amount W | 1,600 V when toner remaining amount W > 300 g<br>1,800 V when W ≦ 300 g |
| Image forming apparatus (s) Vs = 200 mm/sec | 1,600 V irrespective of toner remaining amount W | 1,600 V irrespective of toner remaining amount W |

"

should read

UNITED STATES PATENT AND TRADEMARK OFFICE

CERTIFICATE OF CORRECTION

PATENT NO. : 7,215,904 B2
APPLICATION NO. : 11/052525
DATED : May 8, 2007
INVENTOR(S) : Hideaki Hasegawa et al.

It is certified that error appears in the above-identified patent and that said Letters Patent is hereby corrected as shown below:

Table 3

--

| Peak-to-peak voltage of A.C. voltage of developing bias voltage | | |
|---|---|---|
| Temperature | T < 28°C | 28°C ≤ T |
| Image forming apparatus (f) Vf = 300 mm/sec | 1,600 V irrespective of toner remaining amount W | 1,600 V when toner remaining amount W > 300g 1,800 V when W ≤ 300 g |
| Image forming apparatus (s) Vs = 200 mm/sec | 1,600 V irrespective of toner remaining amount W | 1,600 V irrespective of toner remaining amount W |

--.

COLUMN 15
Line 35, "an" should read --a--.

COLUMN 18
Line 1, "M ≧ 1," should read --M ≥--.
Line 2, "000g" should read --1000g--.

UNITED STATES PATENT AND TRADEMARK OFFICE

CERTIFICATE OF CORRECTION

PATENT NO. : 7,215,904 B2
APPLICATION NO. : 11/052525
DATED : May 8, 2007
INVENTOR(S) : Hideaki Hasegawa et al.

It is certified that error appears in the above-identified patent and that said Letters Patent is hereby corrected as shown below:

COLUMN 19
Line 67, “has a” should be --has an--.

COLUMN 20
Line 19, “tones” should read --toner-- and “substantially)” should read --substantial)--.
Line 23, “the becomes” should read --becomes the--.
Line 46, “fifth” should read --Fifth--.

COLUMN 22
Table 6, “W ≦” should read --W >--.

COLUMN 23
Line 4, “S412)” should read --(S412).--.

Signed and Sealed this

Sixteenth Day of June, 2009

JOHN DOLL
*Acting Director of the United States Patent and Trademark Office*